US009093017B2

(12) United States Patent
Phan

(10) Patent No.: US 9,093,017 B2
(45) Date of Patent: Jul. 28, 2015

(54) IMAGE DEVICE WITH PIXEL DOTS WITH MULTI-PRIMARY COLORS

(71) Applicant: VP ASSETS LIMITED, Hong Kong (CN)

(72) Inventor: Gia Chuong Phan, Hong Kong (CN)

(73) Assignee: VP ASSETS LIMITED, Tortola (VG)

( * ) Notice: Subject to any disclaimer, the term of this patent is extended or adjusted under 35 U.S.C. 154(b) by 0 days.

(21) Appl. No.: 14/270,012

(22) Filed: May 5, 2014

(65) Prior Publication Data

US 2014/0240205 A1 Aug. 28, 2014

Related U.S. Application Data

(63) Continuation-in-part of application No. 12/906,619, filed on Oct. 18, 2010, now Pat. No. 8,717,255.

(51) Int. Cl.
*G09G 3/20* (2006.01)

(52) U.S. Cl.
CPC ..... *G09G 3/2003* (2013.01); *G09G 2300/0452* (2013.01); *G09G 2340/0457* (2013.01)

(58) Field of Classification Search
CPC ..... G09G 3/2003; G09G 2340/0457; G09G 2300/0452
USPC ..... 345/76–101, 204–211
See application file for complete search history.

(56) References Cited

U.S. PATENT DOCUMENTS

| | | | | |
|---|---|---|---|---|
| 4,800,375 | A | 1/1989 | Silverstein et al. | |
| 7,268,757 | B2 | 9/2007 | Ben-David et al. | |
| 7,286,136 | B2 | 10/2007 | Phan | |
| 7,495,722 | B2 | 2/2009 | Roth et al. | |
| 7,505,052 | B2 | 3/2009 | Choe et al. | |
| 7,505,053 | B2 | 3/2009 | Brown et al. | |
| 7,580,093 | B2 | 8/2009 | Rho | |
| 7,701,476 | B2 | 4/2010 | Brown et al. | |
| 7,750,997 | B2 | 7/2010 | Chen et al. | |
| 7,876,339 | B2 | 1/2011 | Okazaki et al. | |
| 7,876,341 | B2 | 1/2011 | Credelle et al. | |
| 7,969,448 | B2 | 6/2011 | Yang et al. | |
| 7,990,403 | B2 | 8/2011 | Ben-David et al. | |
| 2002/0191130 | A1* | 12/2002 | Liang et al. | 349/108 |
| 2004/0051724 | A1* | 3/2004 | Elliott et al. | 345/694 |
| 2004/0174389 | A1 | 9/2004 | Ben-David et al. | |
| 2005/0151752 | A1 | 7/2005 | Phan | |
| 2007/0159492 | A1 | 7/2007 | Lo et al. | |
| 2008/0284947 | A1 | 11/2008 | Li et al. | |
| 2008/0316235 | A1 | 12/2008 | Okazaki et al. | |

(Continued)

FOREIGN PATENT DOCUMENTS

| | | | |
|---|---|---|---|
| CN | 1494036 | A | 5/2004 |
| CN | 1509083 | A | 6/2004 |

(Continued)

*Primary Examiner* — Liliana Cerullo
(74) *Attorney, Agent, or Firm* — Birch, Stewart, Kolasch & Birch, LLP

(57) ABSTRACT

An image device including a plurality of pixel groups. Each pixel group includes a plurality of dots arranged in a predetermined identical matrix form, and each pixel group has at least one first color dot, at least one second color dot, at least one third color dot and at least one fourth color dot. Any repeated sequence of consecutive color dots in a row direction and in a column direction comprise at least one first color dot, at least one second color dot, at least one third color dot, at least one fourth color dot.

15 Claims, 30 Drawing Sheets

(56) References Cited

U.S. PATENT DOCUMENTS

| | | | |
|---|---|---|---|
| 2009/0141381 | A1 | 6/2009 | Itou et al. |
| 2010/0141812 | A1 | 6/2010 | Hirota |
| 2011/0273493 | A1 | 11/2011 | Yoshiga et al. |
| 2012/0092237 | A1 | 4/2012 | Phan |

FOREIGN PATENT DOCUMENTS

| | | | |
|---|---|---|---|
| CN | 1722193 | A | 1/2006 |
| CN | 101286311 | A | 10/2008 |
| CN | 102243828 | A | 11/2011 |

* cited by examiner

IMAGE DEVICE WITH PIXEL DOTS WITH MULTI-PRIMARY COLORS

CROSS-REFERENCE TO RELATED APPLICATION

The present application is a Continuation-in-Part of U.S. application Ser. No. 12/906,619, filed Oct. 18, 2010 the contents of which are incorporated in their entirety.

BACKGROUND OF THE INVENTION

1. Field of the Invention

The invention relates to an image device, and particularly to an image device with repeated sequence of consecutive color dots in a row direction and in a column direction.

2. Description of the Related Art

Referring to FIG. 1, it shows a conventional RGB stripe display. The conventional RGB stripe display 10 comprises a plurality of RGB pixel groups 11 and 12. The RGB pixel group 11 includes a red dot (R1) 111, a green dot (G1) 112 and a blue dot (B1) 113 arranged in a row direction, and the RGB pixel group 12 includes a red dot (R2) 121, a green dot (G2) 122 and a blue dot (B2) 123 arranged next to the RGB pixel group 11 in the row direction. In a column direction, the same color dots, for example red dot 111, are arranged in the same column, therefore one column alone does not have all the colors needed for creating a white color column.

U.S. Pat. No. 7,583,279 teaches different non conventional multicolor displays wherein black and white line can be formed in rows or columns. The deficiency is that such display uses stripe subpixels which need at least 2 columns to contain all the multi color for forming a white column since one column alone does not have all the colors needed for creating a white color.

Therefore, there is a need for an image display to solve the above problems.

SUMMARY OF THE INVENTION

The present invention is to provide an image device. The image device includes a plurality of pixel groups. Each pixel group includes a plurality of dots arranged in a predetermined identical matrix form, and each pixel group has at least one first color dot, at least one second color dot, at least one third color dot and at least one fourth color dot. Any repeated sequence of consecutive color dots in a row direction and in a column direction comprise at least one first color dot, at least one second color dot, at least one third color dot, at least one fourth color dot.

The advantage of the invention is to provide all multi-primary colors in a single row or column so that by using subpixel rendering method, black and white lines can be formed in rows or columns, thus reducing the number of columns in a multi-primary colors display.

BRIEF DESCRIPTION OF THE DRAWINGS

Further advantageous measures are described in the dependent claims. The invention is shown in the attached drawing and is described hereinafter in greater detail.

DETAILED DESCRIPTION OF THE INVENTION

Figure 2:
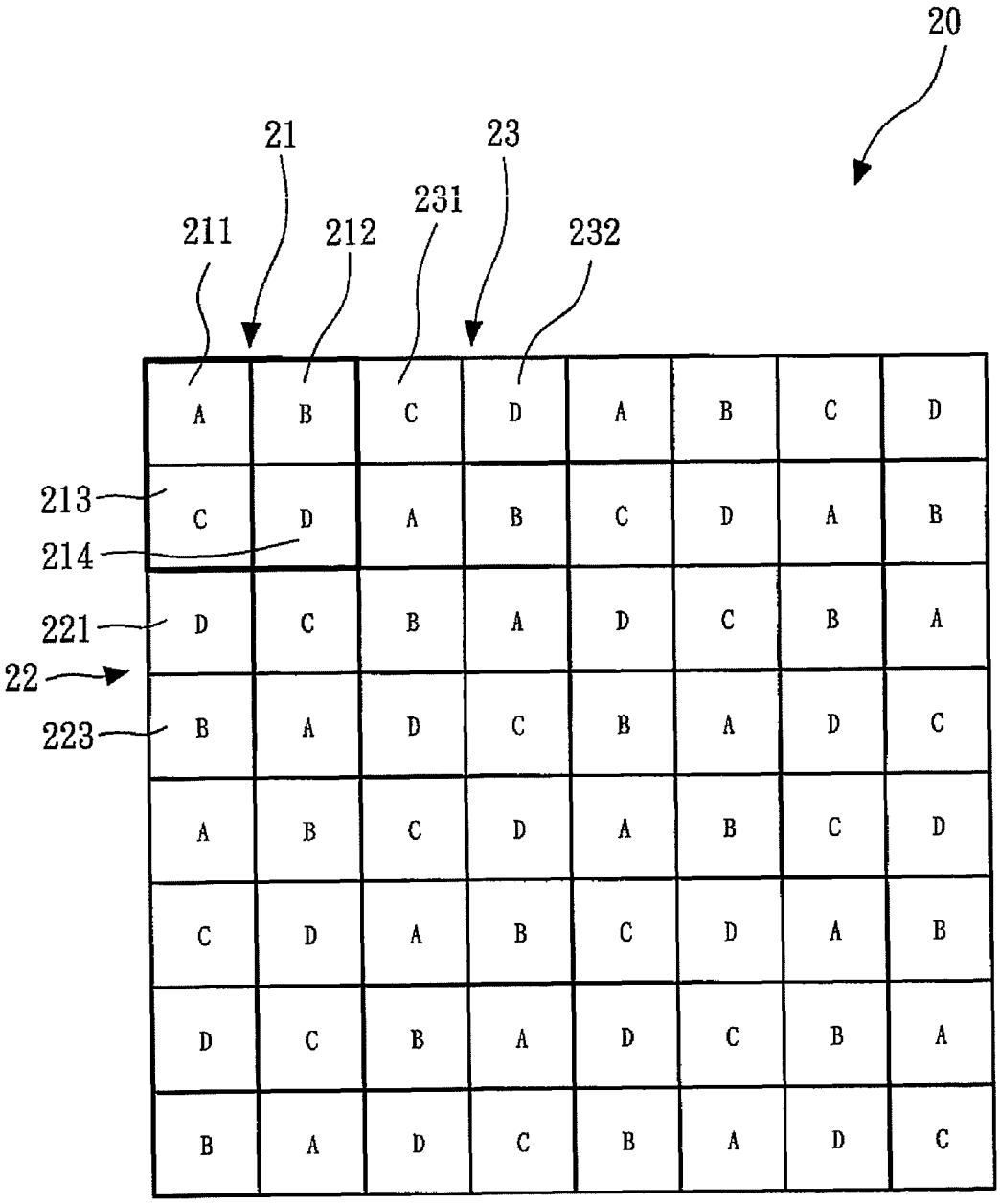
FIG. 2 shows the image device according to a first embodiment of the invention.

Referring to FIG. 2, it shows the image device according to a first embodiment of the invention. The image device 20 includes a plurality of pixel groups 21, 22, 23. Each pixel group includes a plurality of dots arranged in a predetermined identical matrix form, and each pixel group has at least one first color dot, at least one second color dot, at least one third color dot and at least one fourth color dot. For example, the first pixel group 21 has at least one first color dot 211 (A), at least one second color dot 212 (B), at least one third color dot 213 (C) and at least one fourth color dot 214 (D). The first color dot 211 (A), the second color dot 212 (B), the third color dot 213 (C) and the fourth color dot 214 (D) do not be limited to any color.

In this embodiment, the pixel group comprises four color dots arranged in a 2×2 matrix. An initial 2×2 pixel group, for example the first pixel group 21, in the upper left corner of the image device 21 comprises at least one first color dot 211 (A), at least one second color dot 212 (B), at least one third color dot 213 (C) and at least one fourth color dot 214 (D).

Any repeated sequence of consecutive color dots in a row direction and in a column direction comprise at least one first color dot, at least one second color dot, at least one third color dot, at least one fourth color dot. In this embodiment, the repeated sequence of consecutive color dots in the row direction comprises for example the first color dot 211 (A) of the first pixel group 21, the second color dot 212 (B) of the first pixel group 21, the third color dot 231 (C) of the third pixel group 23, the fourth color dot 232 (D) of the third pixel group 23, and the same repeated sequence of consecutive color dots are arranged sequentially and repeatedly in the row direction.

The repeated sequence of consecutive color dots in the column direction comprises for example the first color dot 211 (A) of the first pixel group 21, the third color dot 213 (C) of the first pixel group 21, the fourth color dot 221 (D) of the second pixel group 22, the second color dot 223 (B) of the second pixel group 22, and the same repeated sequence of consecutive color dots are arranged sequentially and repeatedly in the column direction.

Figure 3:
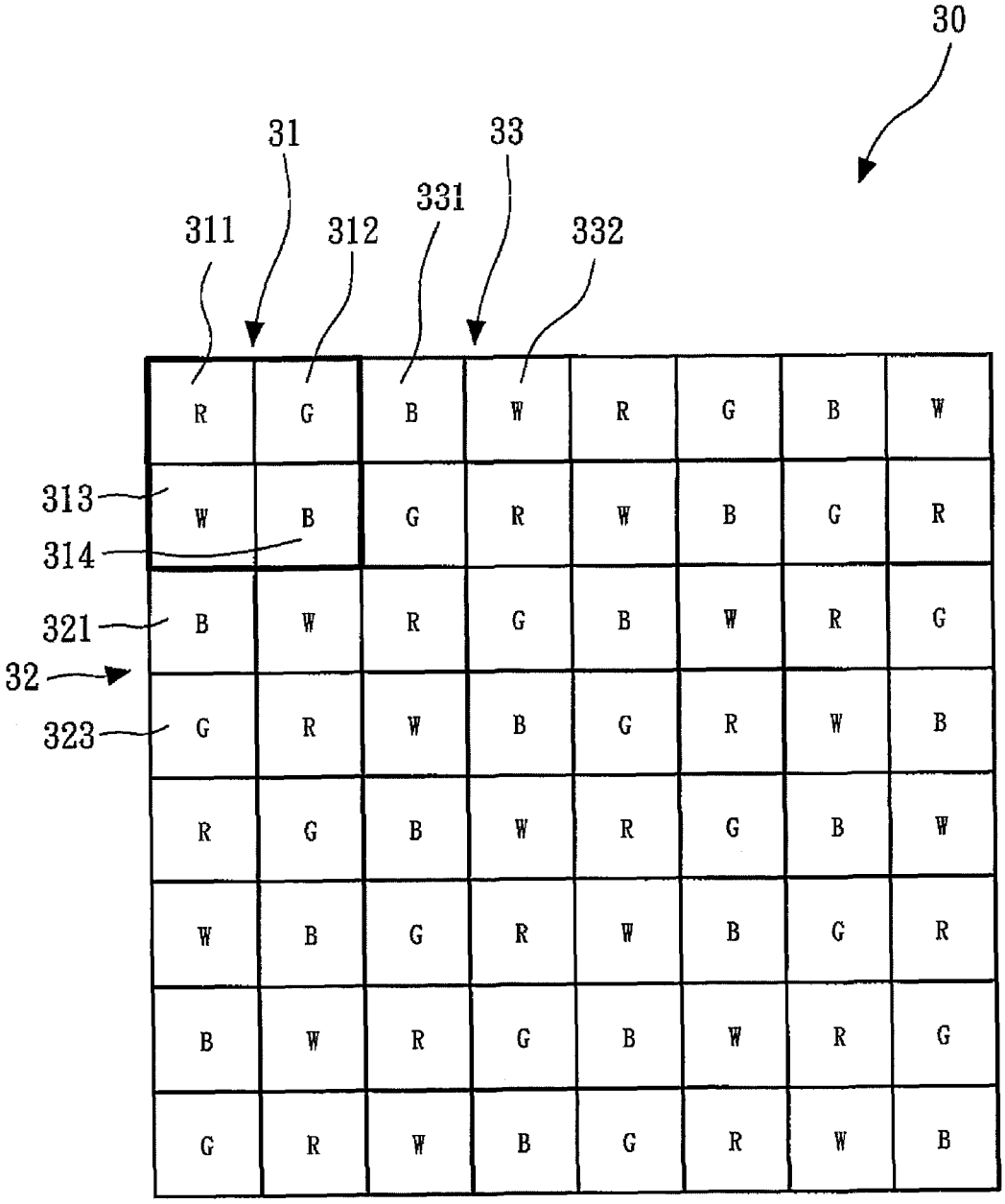
FIG. 3 shows the image device according to a second embodiment of the invention.

Referring to FIG. 3, it shows the image device according to a second embodiment of the invention. The image device 30 includes a plurality of pixel groups 31, 32, 33. Each pixel group includes a plurality of dots arranged in a predetermined identical matrix form, and each pixel group has at least one first color dot, at least one second color dot, at least one third color dot and at least one fourth color dot. For example, the first pixel group 31 has at least one red color dot 311 (R), at least one green color dot 312 (G), at least one white color dot 313 (W) and at least one blue color dot 314 (B). In this embodiment, each pixel group comprises at least one white color dot, and each pixel group comprises at least one red color dot, one green color dot and one blue color dot. Preferably, red color dot (R) and blue color dot (B) are disposed on diagonal positions of the predetermined identical matrix of the pixel group. Furthermore, same color dots do not share common edge line.

Any repeated sequence of consecutive color dots in a row direction and in a column direction comprise at least one first color dot, at least one second color dot, at least one third color dot, at least one fourth color dot. In this embodiment, the repeated sequence of consecutive color dots in the row direction comprises for example the red color dot 311 (R) of the first pixel group 31, the green color dot 312 (G) of the first pixel group 31, the blue color dot 331 (B) of the third pixel group 33, the white color dot 332 (W) of the third pixel group 33, and the same repeated sequence of consecutive color dots are arranged sequentially and repeatedly in the row direction.

Figure 1:
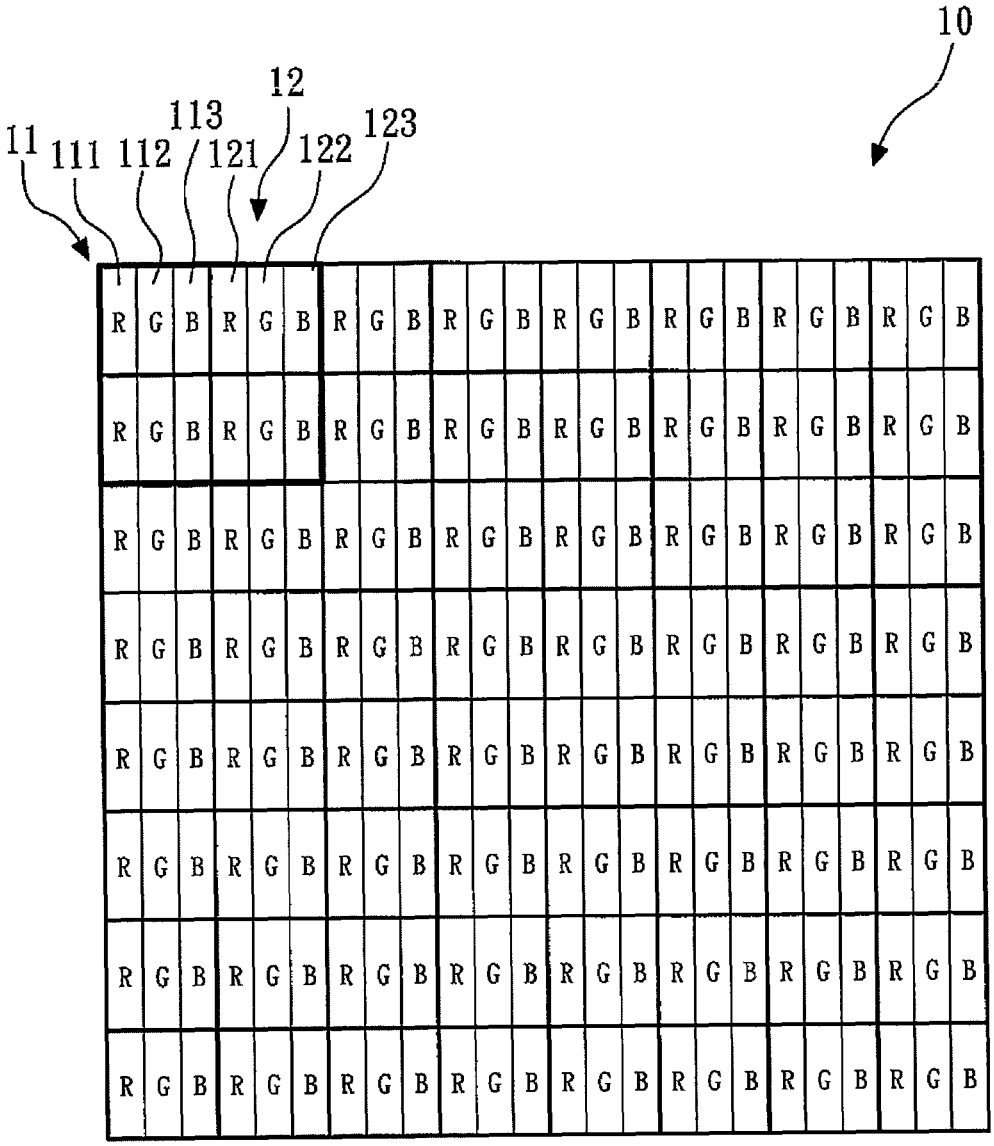
FIG. 1 shows a conventional RGB stripe display.

The repeated sequence of consecutive color dots in the column direction comprises for example the red color dot 311 (R) of the first pixel group 31, the white color dot 313 (W) of the first pixel group 31, the blue color dot 321 (B) of the second pixel group 32, the green color dot 323 (G) of the second pixel group 32, and the same repeated sequence of consecutive color dots are arranged sequentially and repeatedly in the column direction. Furthermore, in this embodiment, the area of 2×2 color dots is equal to the corresponding area of 2×2 RGB pixel groups of a conventional RGB stripe display (as shown in FIG. 1).

Figure 4:
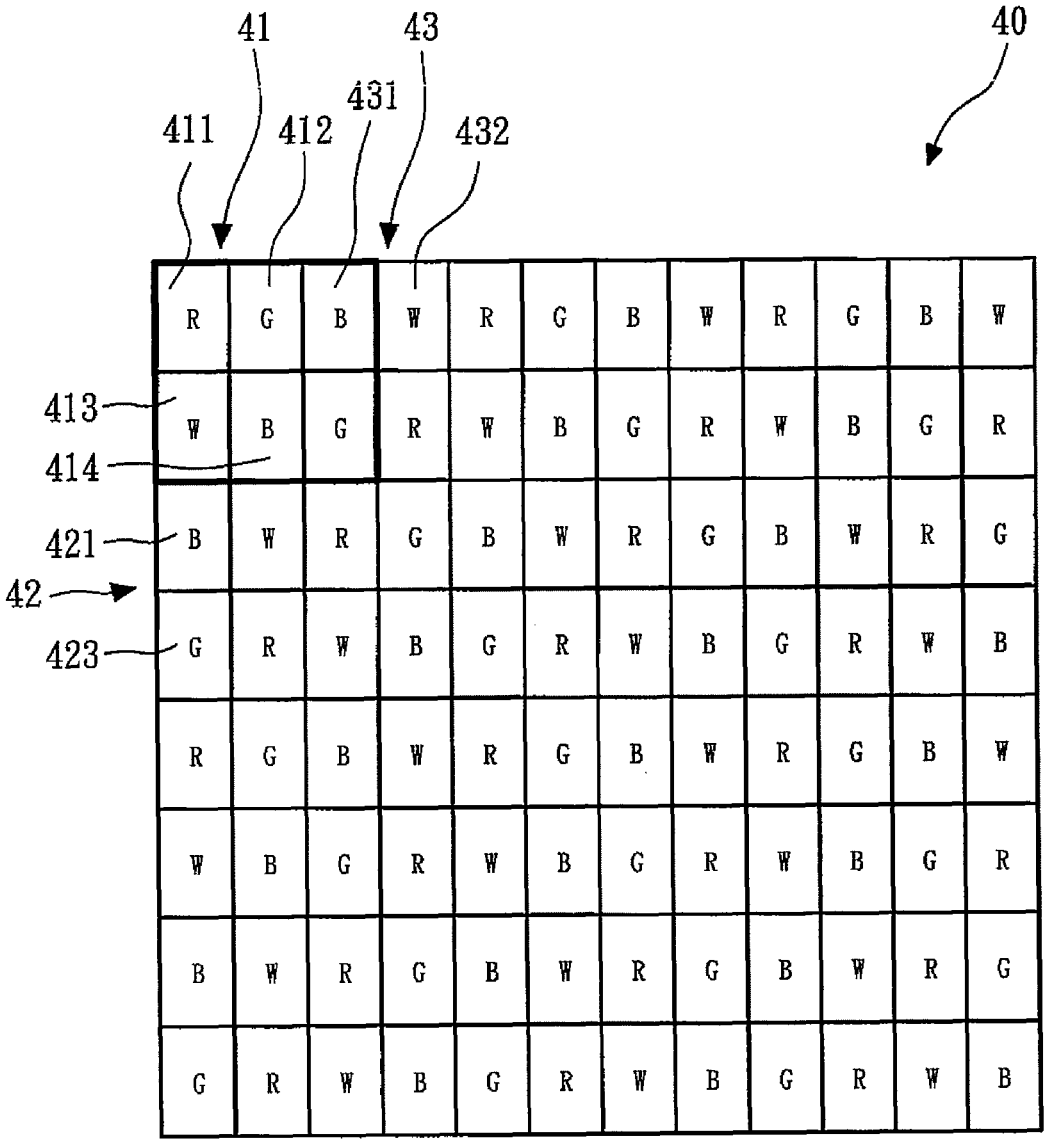
FIG. 4 shows the image device according to a third embodiment of the invention.

Referring to FIG. 4, it shows the image device according to a third embodiment of the invention. The image device 40 includes a plurality of pixel groups 41, 42, 43. The pixel group comprises four color dots arranged in a 2×2 matrix. In this embodiment, the repeated sequence of consecutive color dots in the row direction comprises for example the red color dot 411 (R) of the first pixel group 41, the green color dot 412 (G) of the first pixel group 41, the blue color dot 431 (B) of the third pixel group 43, the white color dot 432 (W) of the third pixel group 43, and the same repeated sequence of consecutive color dots are arranged sequentially and repeatedly in the row direction.

The repeated sequence of consecutive color dots in the column direction comprises for example the red color dot 411 (R) of the first pixel group 41, the white color dot 413 (W) of the first pixel group 41, the blue color dot 421 (B) of the second pixel group 42, the green color dot 423 (G) of the second pixel group 42, and the same repeated sequence of consecutive color dots are arranged sequentially and repeatedly in the column direction. The difference between the second embodiment and the third embodiment is that, in this embodiment, the area of 3×2 color dots is equal to the corresponding area of 2×2 RGB pixel groups of a conventional RGB stripe display (as shown in FIG. 1).

Figure 5:
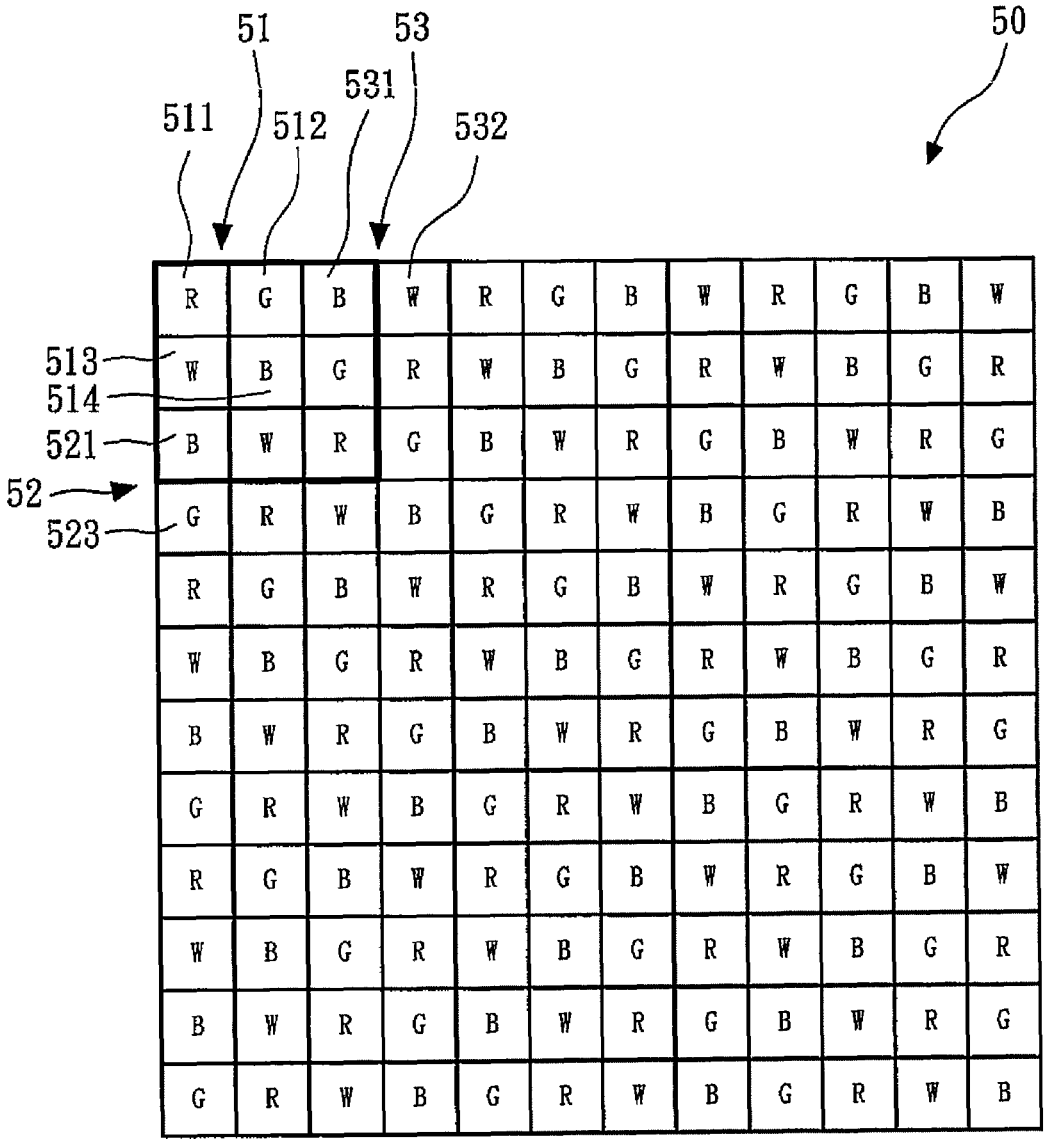
FIG. 5 shows the image device according to a fourth embodiment of the invention.

Referring to FIG. 5, it shows the image device according to a fourth embodiment of the invention. The image device 50 includes a plurality of pixel groups 51, 52, 53. The pixel group comprises four color dots arranged in a 2×2 matrix. In this embodiment, the repeated sequence of consecutive color dots in the row direction comprises for example the red color dot 511 (R) of the first pixel group 51, the green color dot 512 (G) of the first pixel group 51, the blue color dot 531 (B) of the third pixel group 53, the white color dot 532 (W) of the third pixel group 53, and the same repeated sequence of consecutive color dots are arranged sequentially and repeatedly in the row direction.

The repeated sequence of consecutive color dots in the column direction comprises for example the red color dot 511 (R) of the first pixel group 51, the white color dot 513 (W) of the first pixel group 51, the blue color dot 521 (B) of the second pixel group 52, the green color dot 523 (G) of the second pixel group 52, and the same repeated sequence of consecutive color dots are arranged sequentially and repeatedly in the column direction. The difference between the second embodiment and the fourth embodiment is that, in this embodiment, the area of 3×3 color dots is equal to the corresponding area of 2×2 RGB pixel groups of a conventional RGB stripe display (as shown in FIG. 1).

Figure 6:
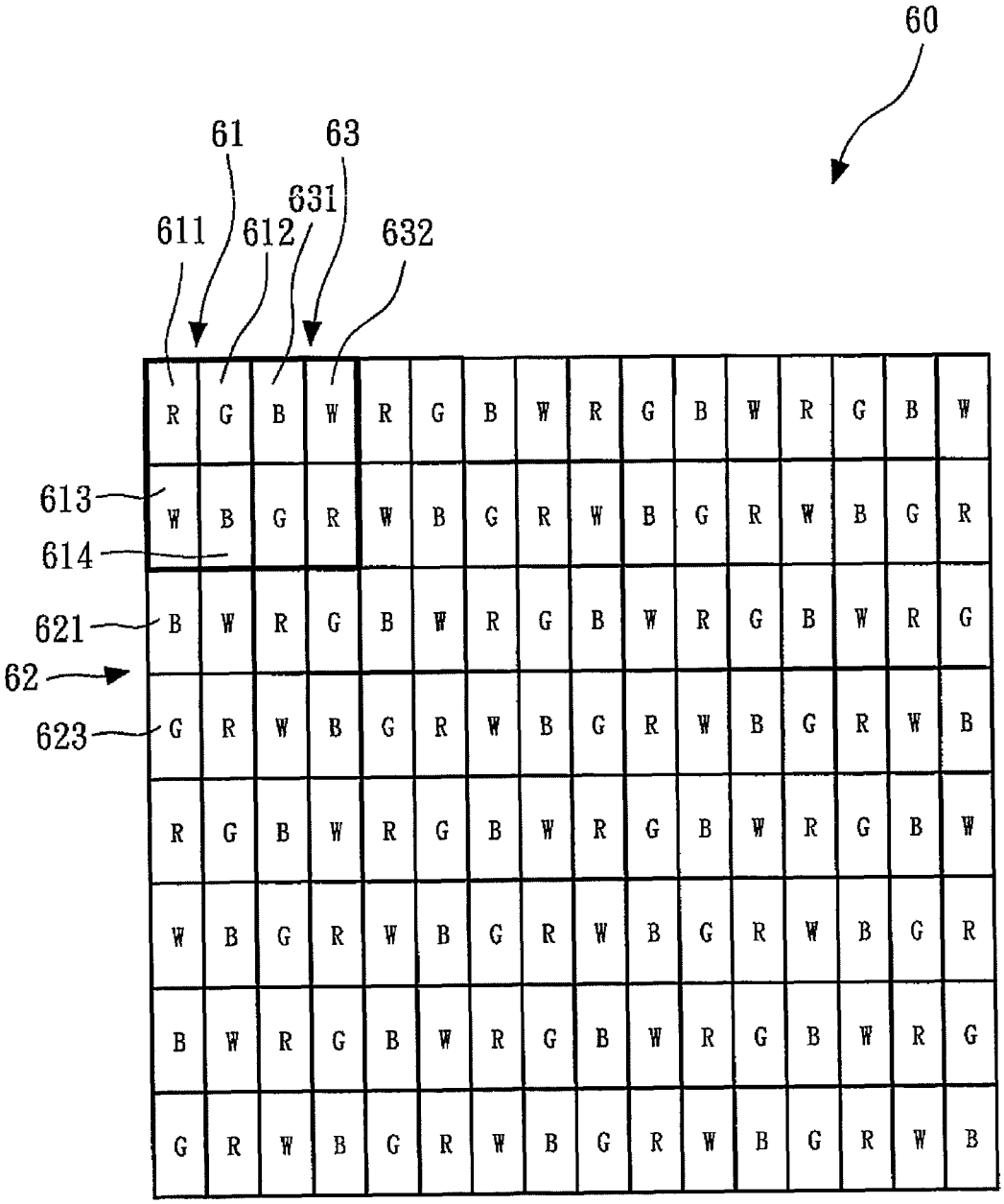
FIG. 6 shows the image device according to a fifth embodiment of the invention.

Referring to FIG. 6, it shows the image device according to a fifth embodiment of the invention. The image device 60 includes a plurality of pixel groups 61, 62, 63. The pixel group comprises four color dots arranged in a 2×2 matrix. In this embodiment, the repeated sequence of consecutive color dots in the row direction comprises for example the red color dot 611 (R) of the first pixel group 61, the green color dot 612 (G) of the first pixel group 61, the blue color dot 631 (B) of the third pixel group 63, the white color dot 632 (W) of the third pixel group 63, and the same repeated sequence of consecutive color dots are arranged sequentially and repeatedly in the row direction.

The repeated sequence of consecutive color dots in the column direction comprises for example the red color dot 611 (R) of the first pixel group 61, the white color dot 613 (W) of the first pixel group 61, the blue color dot 621 (B) of the second pixel group 62, the green color dot 623 (G) of the second pixel group 62, and the same repeated sequence of consecutive color dots are arranged sequentially and repeatedly in the column direction. The difference between the second embodiment and the fourth embodiment is that, in this embodiment, the area of 4×2 color dots is equal to the corresponding area of 2×2 RGB pixel groups of a conventional RGB stripe display (as shown in FIG. 1).

Figure 7:
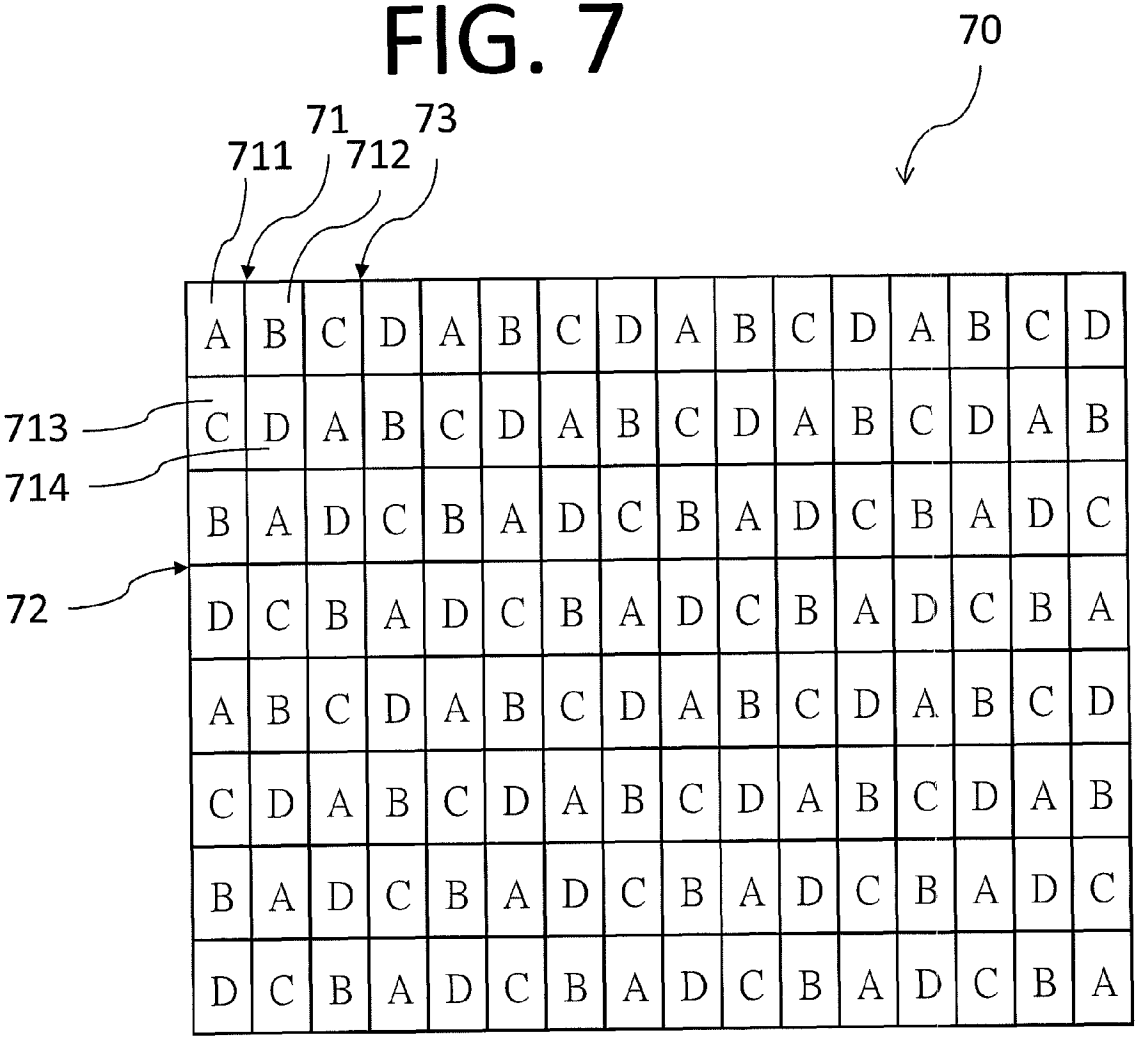
FIG. 7 shows the image device according to a sixth embodiment of the invention.

Referring to FIG. 7, it shows the image device according to another embodiment of the invention. The image device 70 includes a plurality of pixel groups 71, 72, 73. Each pixel group includes a plurality of dots arranged in a predetermined identical matrix form, and each pixel group has at least one first color dot, at least one second color dot, at least one third color dot and at least one fourth color dot. For example, the first pixel group 71 has at least one first color dot 711 (A), at least one second color dot 712 (B), at least one third color dot 713 (C) and at least one fourth color dot 714 (D). Any repeated sequence of consecutive color dots in a row direction and in a column direction comprise at least one first color dot, at least one second color dot, at least one third color dot, at least one fourth color dot.

Figure 8:
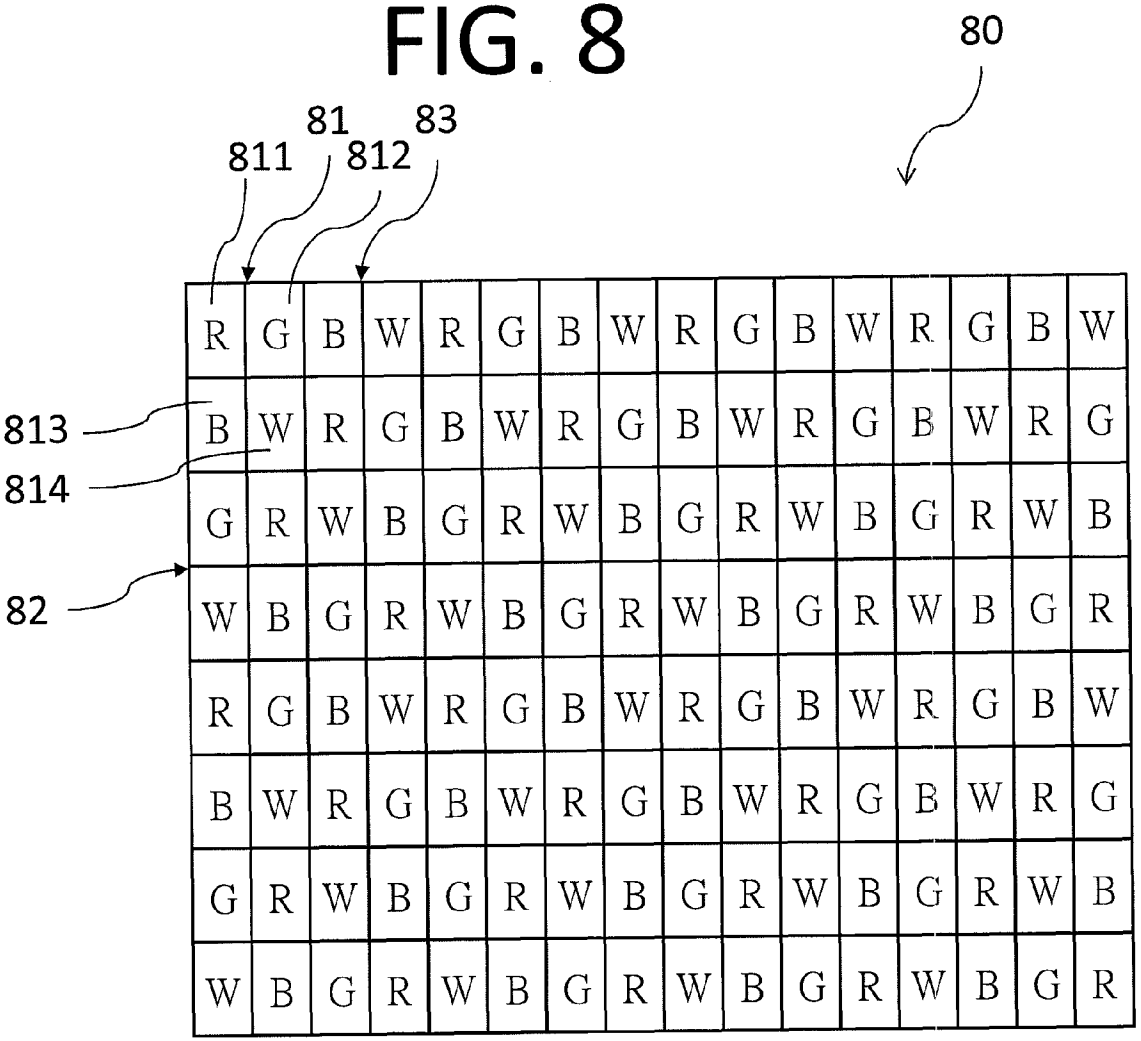
FIG. 8 shows the image device according to a seventh embodiment of the invention.

Referring to FIG. 8, it shows the image device according to another embodiment of the invention. The image device 80 includes a plurality of pixel groups 81, 82, 83. Each pixel group includes a plurality of dots arranged in a predetermined identical matrix form, and each pixel group has at least one first color dot, at least one second color dot, at least one third color dot and at least one fourth color dot. For example, the first pixel group 81 has at least one red color dot 811 (R), at least one green color dot 812 (G), at least one white color dot 814 (W) and at least one blue color dot 813 (B). Any repeated sequence of consecutive color dots in a row direction and in a column direction comprise at least one first color dot, at least one second color dot, at least one third color dot, at least one fourth color dot.

Figure 9:
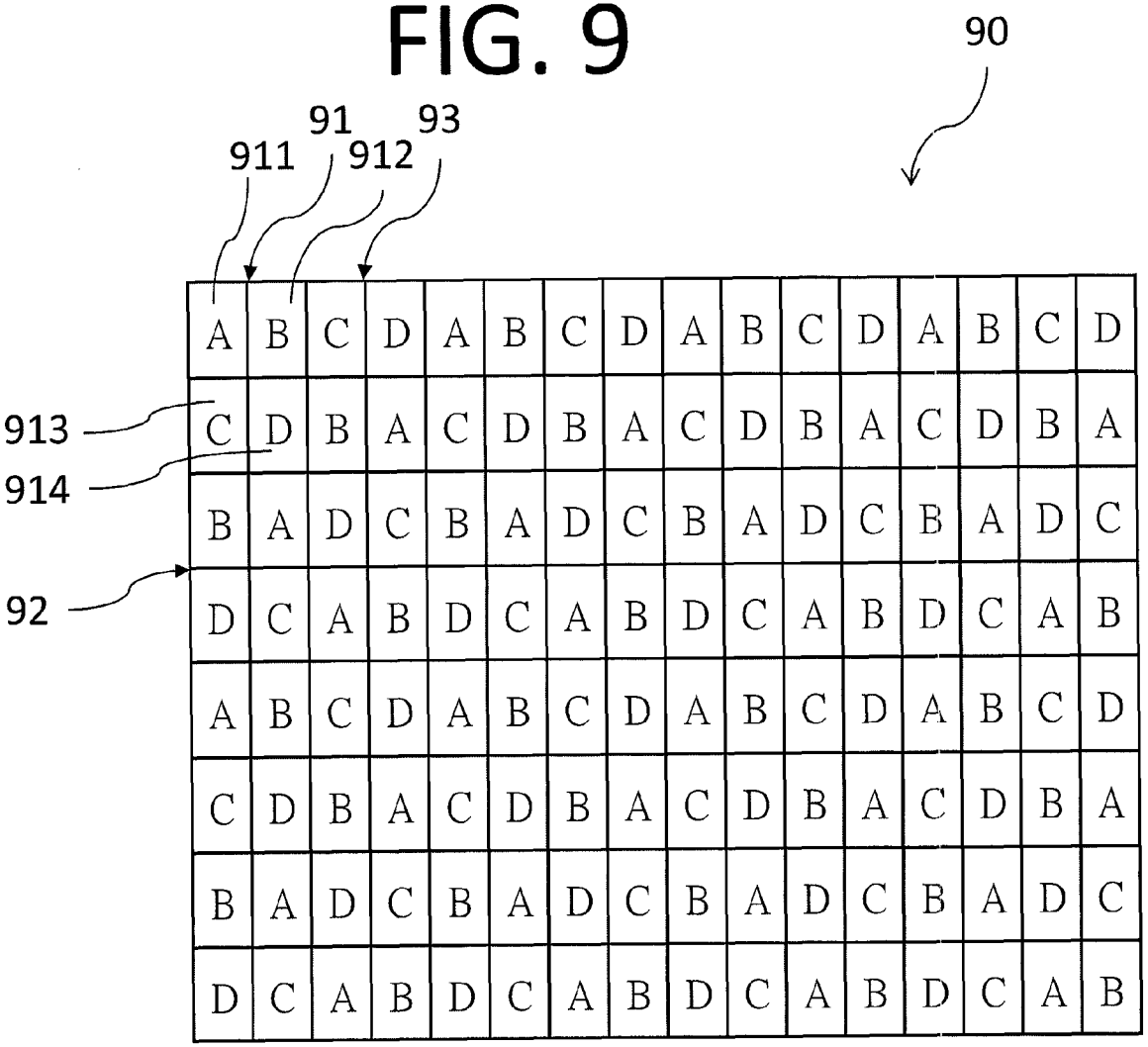
FIG. 9 shows the image device according to an eighth embodiment of the invention.

Referring to FIG. 9, it shows the image device according to another embodiment of the invention. The image device 90 includes a plurality of pixel groups 91, 92, 93. Each pixel group includes a plurality of dots arranged in a predetermined identical matrix form, and each pixel group has at least one first color dot, at least one second color dot, at least one third color dot and at least one fourth color dot. For example, the first pixel group 91 has at least one first color dot 911 (A), at least one second color dot 912 (B), at least one third color dot 913 (C) and at least one fourth color dot 914 (D). Any repeated sequence of consecutive color dots in a row direction and in a column direction comprise at least one first color dot, at least one second color dot, at least one third color dot, at least one fourth color dot.

Figure 10:
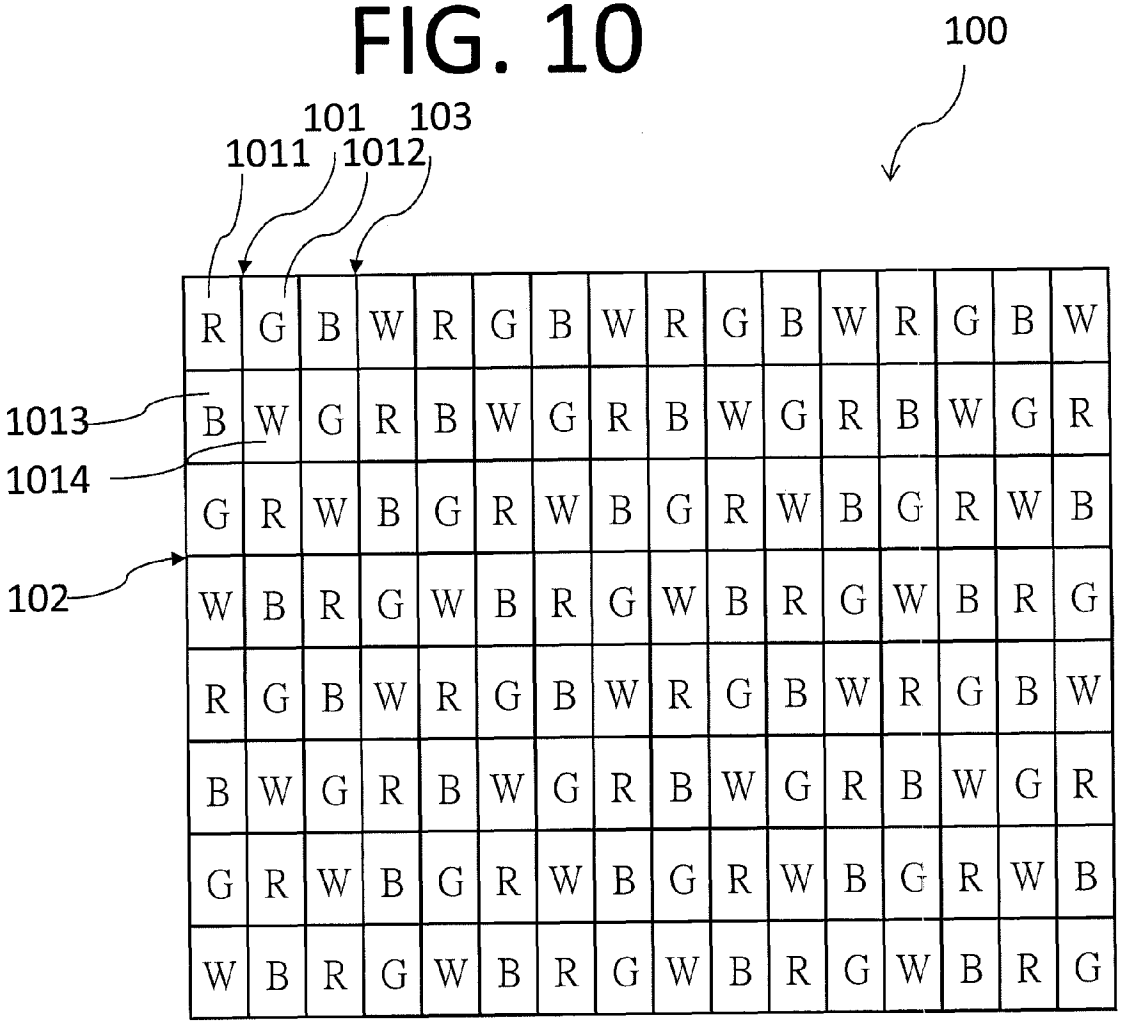
FIG. 10 shows the image device according to a ninth embodiment of the invention.

Referring to FIG. 10, it shows the image device according to another embodiment of the invention. The image device 100 includes a plurality of pixel groups 101, 102, 103. Each pixel group includes a plurality of dots arranged in a predetermined identical matrix fatal, and each pixel group has at least one first color dot, at least one second color dot, at least one third color dot and at least one fourth color dot. For example, the first pixel group 101 has at least one red color dot 1011 (R), at least one green color dot 1012 (G), at least one white color dot 1014 (W) and at least one blue color dot 1013 (B). Any repeated sequence of consecutive color dots in a row direction and in a column direction comprise at least one first color dot, at least one second color dot, at least one third color dot, at least one fourth color dot.

Figure 11:
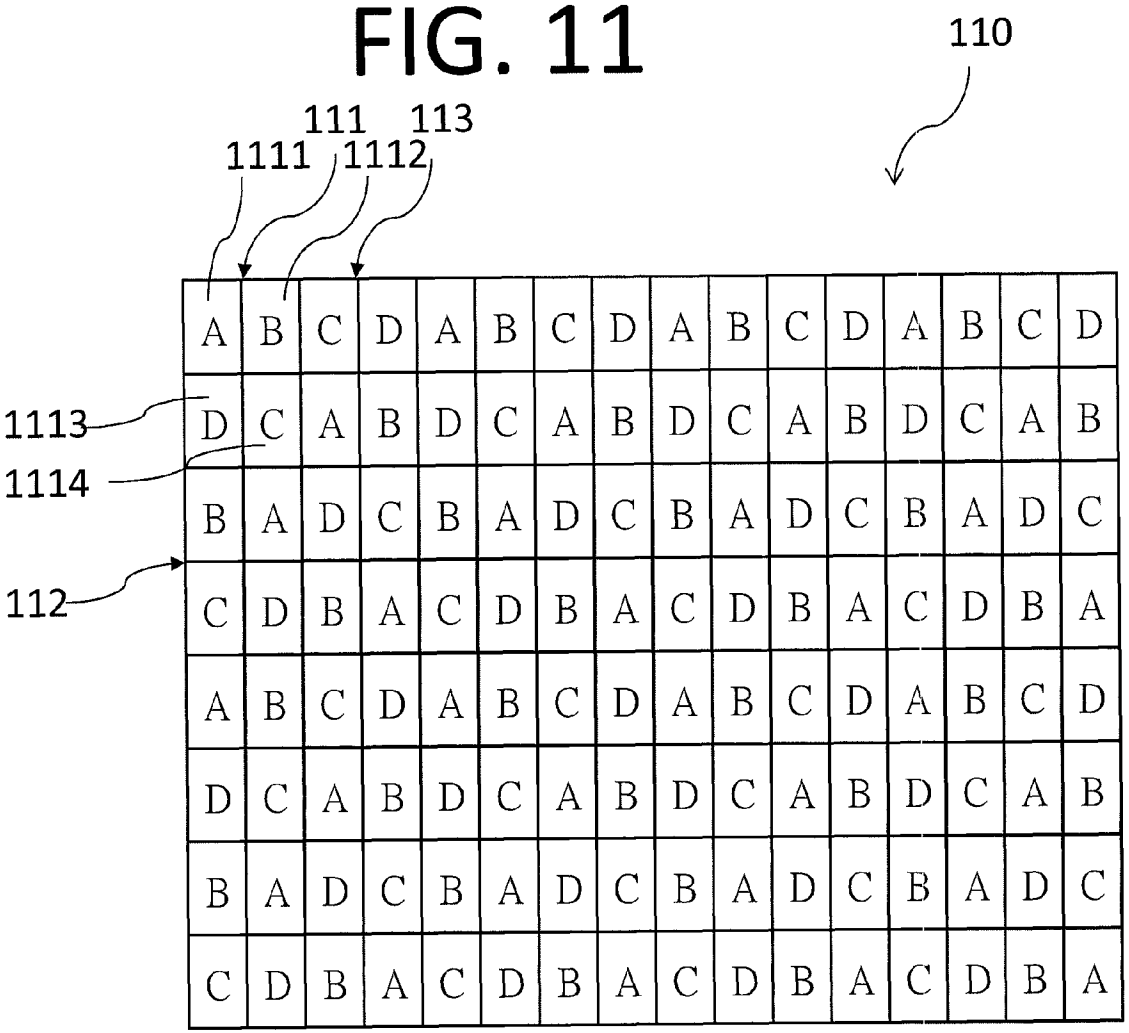
FIG. 11 shows the image device according to a tenth embodiment of the invention.

Referring to FIG. 11, it shows the image device according to another embodiment of the invention. The image device 110 includes a plurality of pixel groups 111, 112, 113. Each pixel group includes a plurality of dots arranged in a predetermined identical matrix form, and each pixel group has at least one first color dot, at least one second color dot, at least one third color dot and at least one fourth color dot. For example, the first pixel group 111 has at least one first color dot 1111 (A), at least one second color dot 1112 (B), at least one third color dot 1114 (C) and at least one fourth color dot 1113 (D). Any repeated sequence of consecutive color dots in a row direction and in a column direction comprise at least one first color dot, at least one second color dot, at least one third color dot, at least one fourth color dot.

Figure 12:
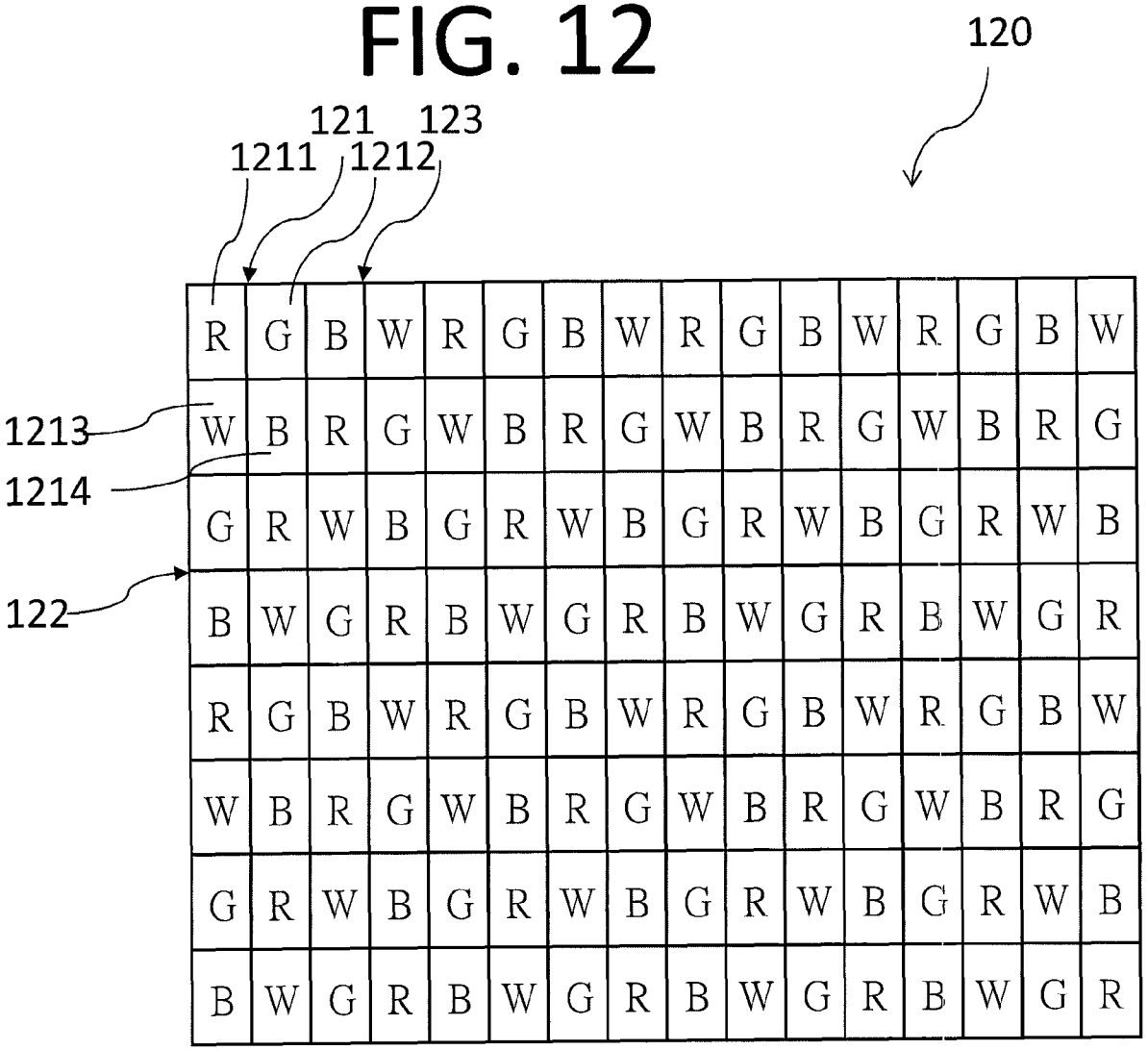
FIG. 12 shows the image device according to an eleventh embodiment of the invention.

Referring to FIG. 12, it shows the image device according to another embodiment of the invention. The image device 120 includes a plurality of pixel groups 121, 122, 123. Each pixel group includes a plurality of dots arranged in a predetermined identical matrix form, and each pixel group has at least one first color dot, at least one second color dot, at least one third color dot and at least one fourth color dot. For example, the first pixel group 121 has at least one red color dot 1211 (R), at least one green color dot 1212 (G), at least one white color dot 1213 (W) and at least one blue color dot 1214 (B). Any repeated sequence of consecutive color dots in a row direction and in a column direction comprise at least one first color dot, at least one second color dot, at least one third color dot, at least one fourth color dot.

Figure 13:
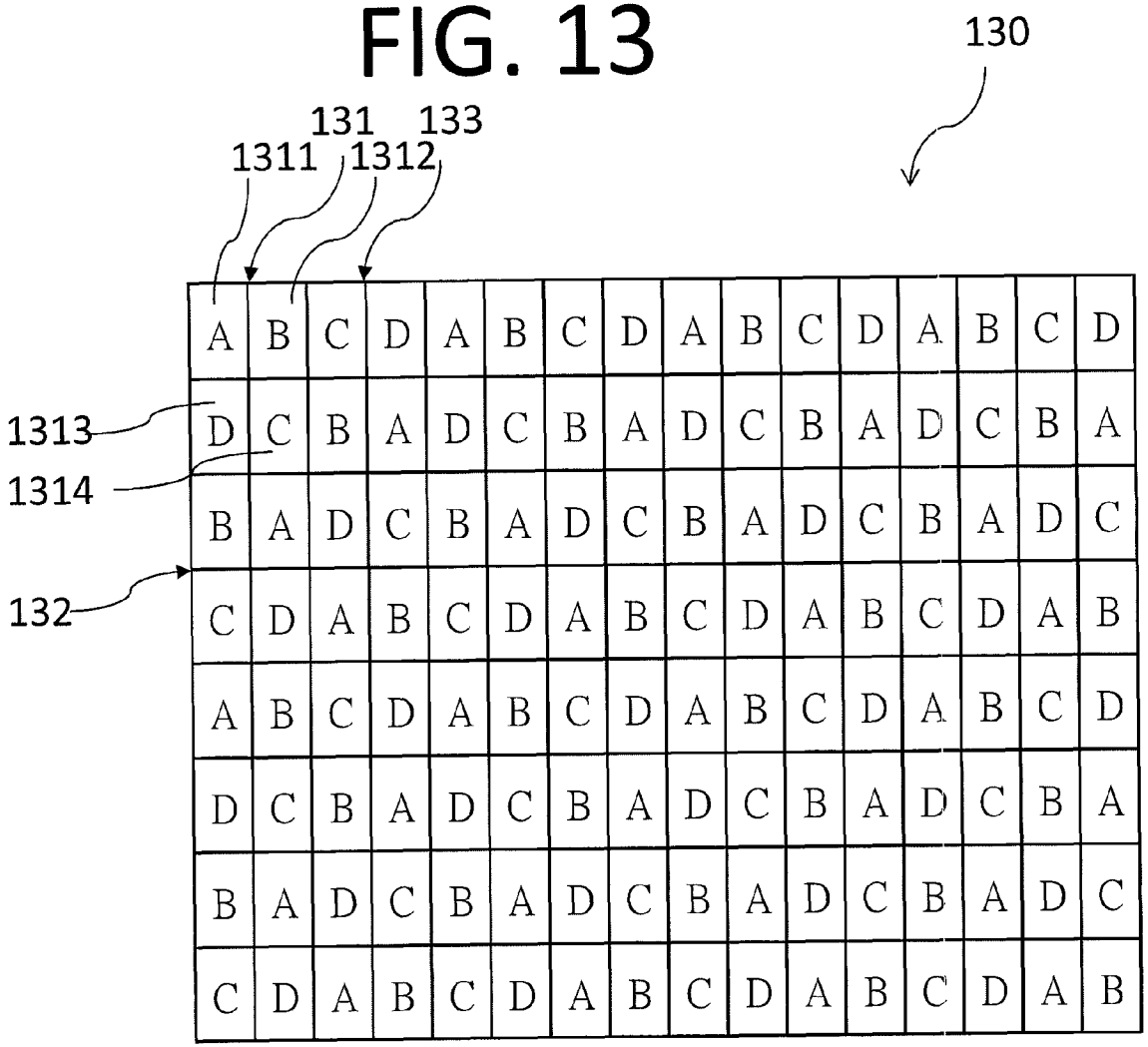
FIG. 13 shows the image device according to a twelfth embodiment of the invention.

Referring to FIG. 13, it shows the image device according to another embodiment of the invention. The image device 130 includes a plurality of pixel groups 131, 132, 133. Each pixel group includes a plurality of dots arranged in a predetermined identical matrix form, and each pixel group has at least one first color dot, at least one second color dot, at least one third color dot and at least one fourth color dot. For example, the first pixel group 131 has at least one first color dot 1311 (A), at least one second color dot 1312 (B), at least one third color dot 1314 (C) and at least one fourth color dot 1313 (D). Any repeated sequence of consecutive color dots in a row direction and in a column direction comprise at least one first color dot, at least one second color dot, at least one third color dot, at least one fourth color dot.

Figure 14:
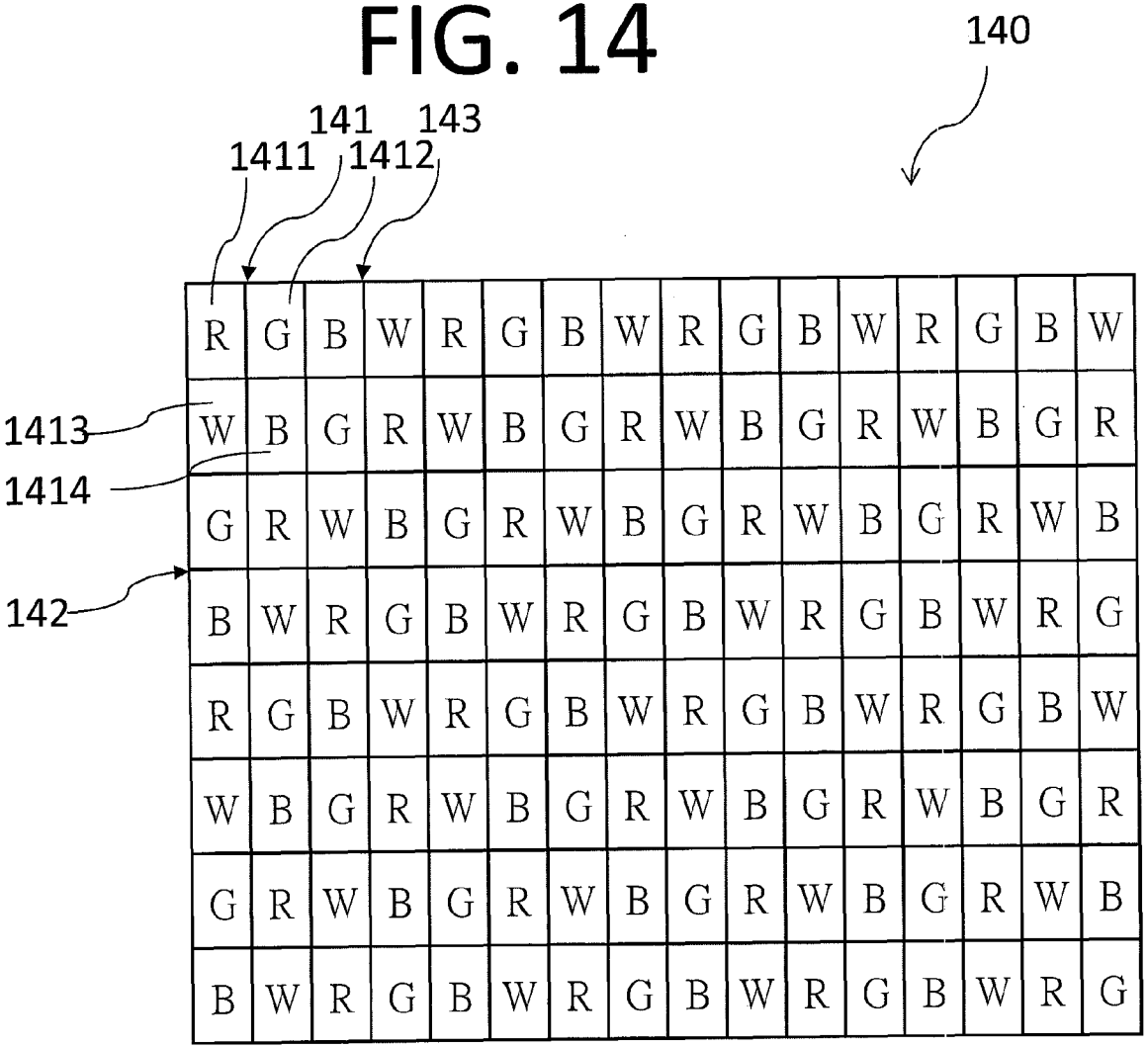
FIG. 14 shows the image device according to a thirteenth embodiment of the invention.

Referring to FIG. 14, it shows the image device according to another embodiment of the invention. The image device 140 includes a plurality of pixel groups 141, 142, 143. Each pixel group includes a plurality of dots arranged in a predetermined identical matrix form, and each pixel group has at least one first color dot, at least one second color dot, at least one third color dot and at least one fourth color dot. For example, the first pixel group 141 has at least one red color dot 1411 (R), at least one green color dot 1412 (G), at least one white color dot 1413 (W) and at least one blue color dot 1414 (B). Any repeated sequence of consecutive color dots in a row direction and in a column direction comprise at least one first color dot, at least one second color dot, at least one third color dot, at least one fourth color dot.

Figure 15:
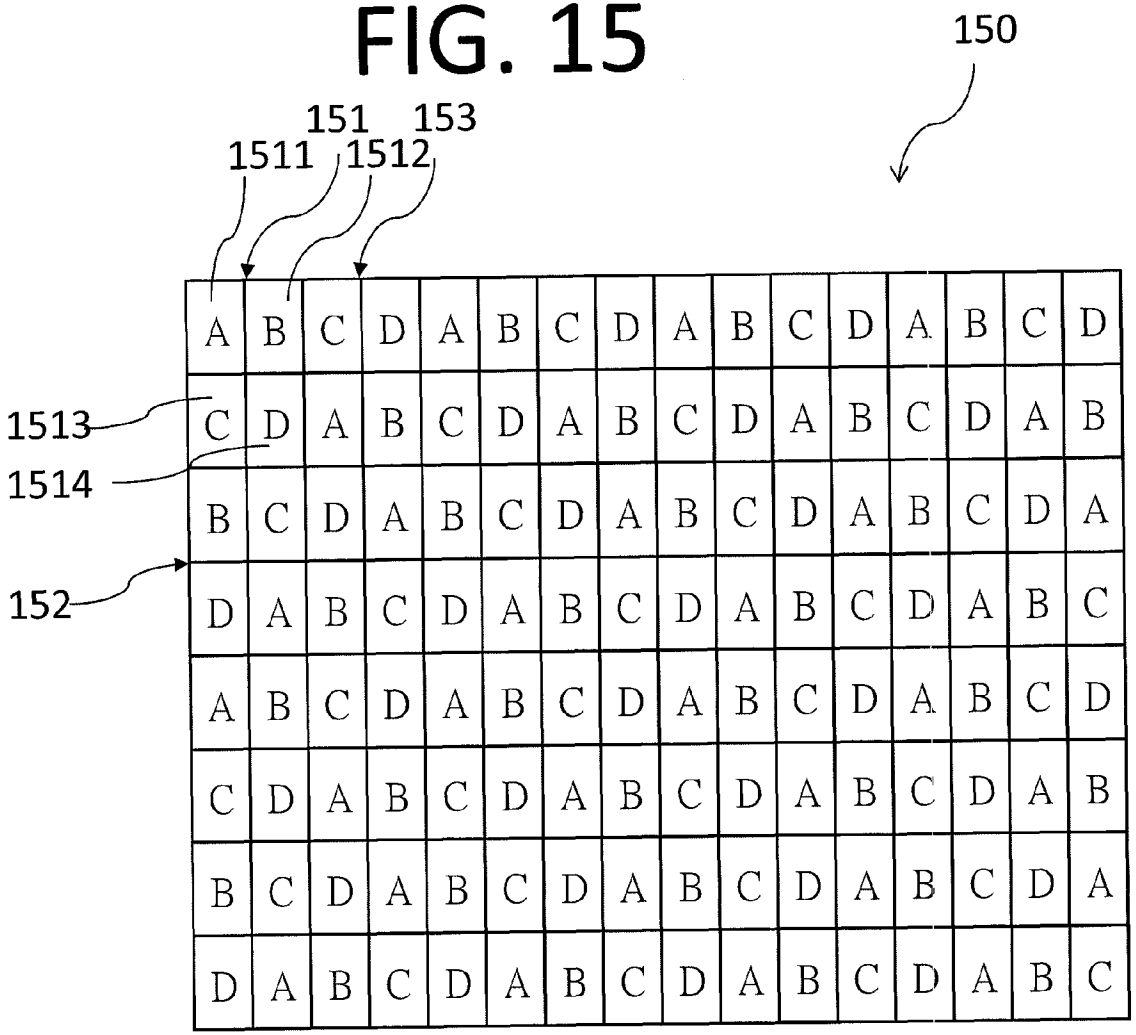
FIG. 15 shows the image device according to a fourteenth embodiment of the invention.

Referring to FIG. 15, it shows the image device according to another embodiment of the invention. The image device 150 includes a plurality of pixel groups 151, 152, 153. Each pixel group includes a plurality of dots arranged in a predetermined identical matrix form, and each pixel group has at least one first color dot, at least one second color dot, at least one third color dot and at least one fourth color dot. For example, the first pixel group 151 has at least one first color dot 1511 (A), at least one second color dot 1512 (B), at least one third color dot 1513 (C) and at least one fourth color dot 1514 (D). Any repeated sequence of consecutive color dots in a row direction and in a column direction comprise at least one first color dot, at least one second color dot, at least one third color dot, at least one fourth color dot.

Figure 16:
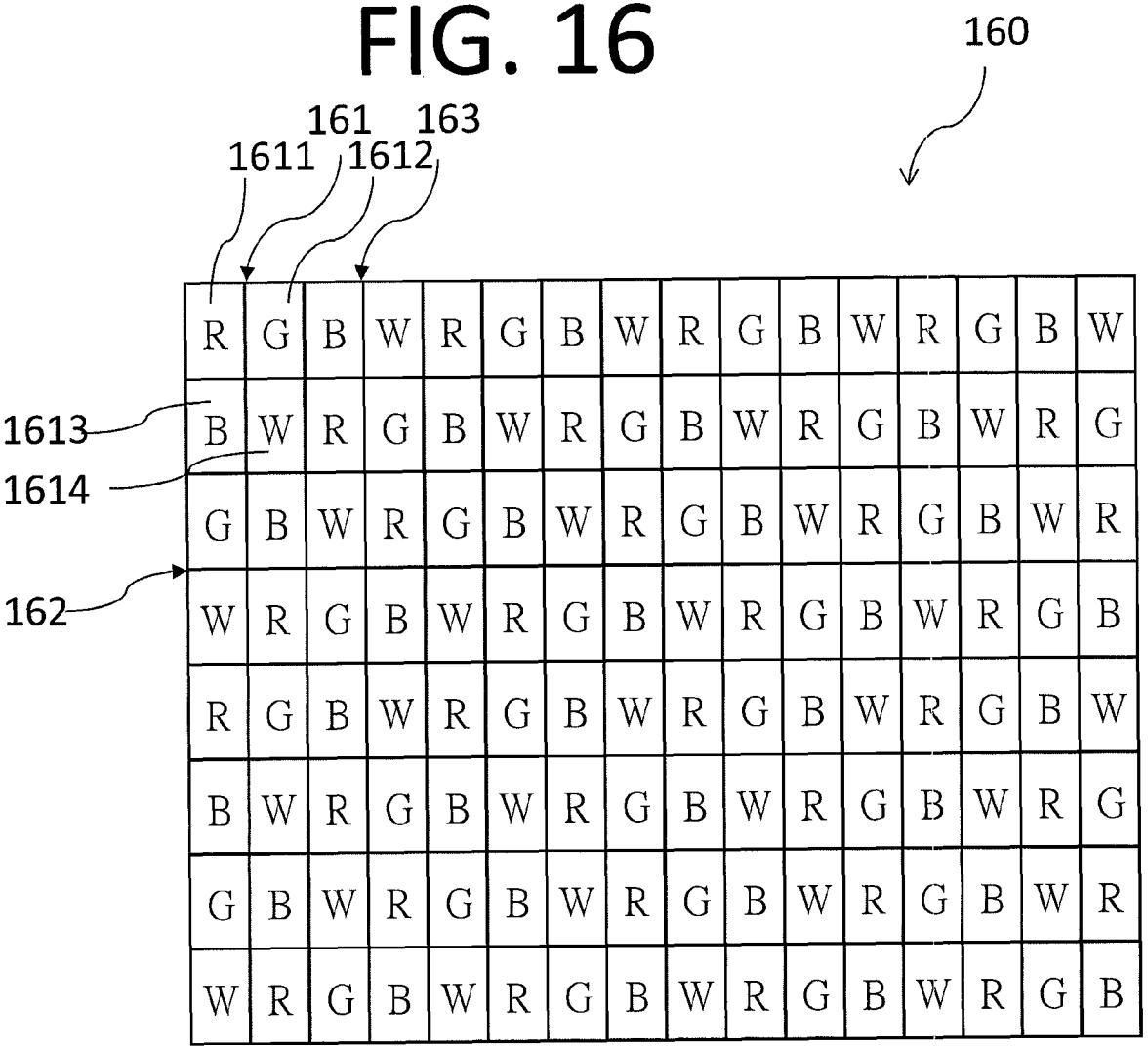
FIG. 16 shows the image device according to a fifteenth embodiment of the invention.

Referring to FIG. 16, it shows the image device according to another embodiment of the invention. The image device 160 includes a plurality of pixel groups 161, 162, 163. Each pixel group includes a plurality of dots arranged in a predetermined identical matrix form, and each pixel group has at least one first color dot, at least one second color dot, at least one third color dot and at least one fourth color dot. For example, the first pixel group 161 has at least one red color dot 1611 (R), at least one green color dot 1612 (G), at least one white color dot 1614 (W) and at least one blue color dot 1613 (B). Any repeated sequence of consecutive color dots in a row direction and in a column direction comprise at least one first color dot, at least one second color dot, at least one third color dot, at least one fourth color dot.

Figure 17:
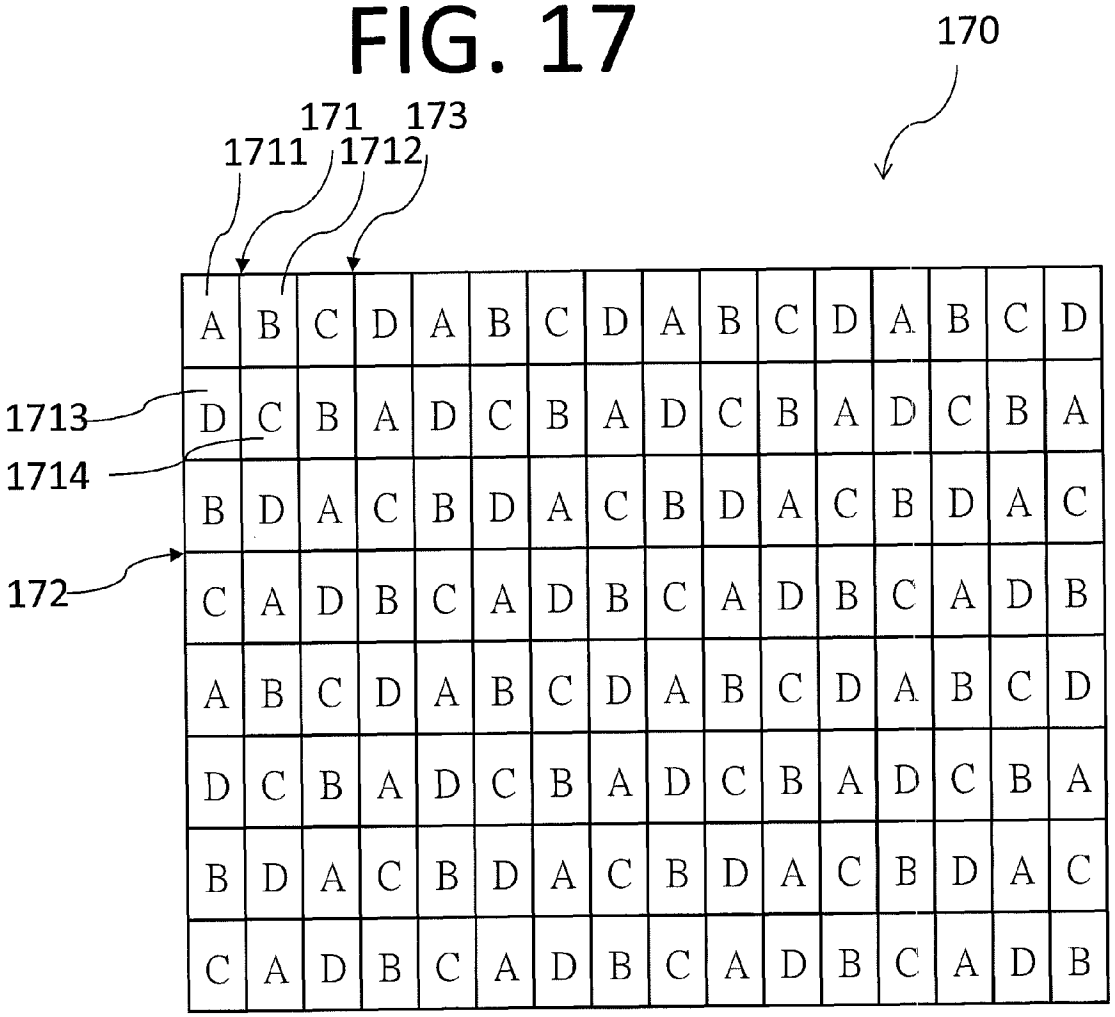
FIG. 17 shows the image device according to a sixteenth embodiment of the invention.

Referring to FIG. 17, it shows the image device according to another embodiment of the invention. The image device 170 includes a plurality of pixel groups 171, 172, 173. Each pixel group includes a plurality of dots arranged in a predetermined identical matrix form, and each pixel group has at least one first color dot, at least one second color dot, at least one third color dot and at least one fourth color dot. For example, the first pixel group 171 has at least one first color dot 1711 (A), at least one second color dot 1712 (B), at least one third color dot 1714 (C) and at least one fourth color dot 1713 (D). Any repeated sequence of consecutive color dots in a row direction and in a column direction comprise at least one first color dot, at least one second color dot, at least one third color dot, at least one fourth color dot.

Figure 18:
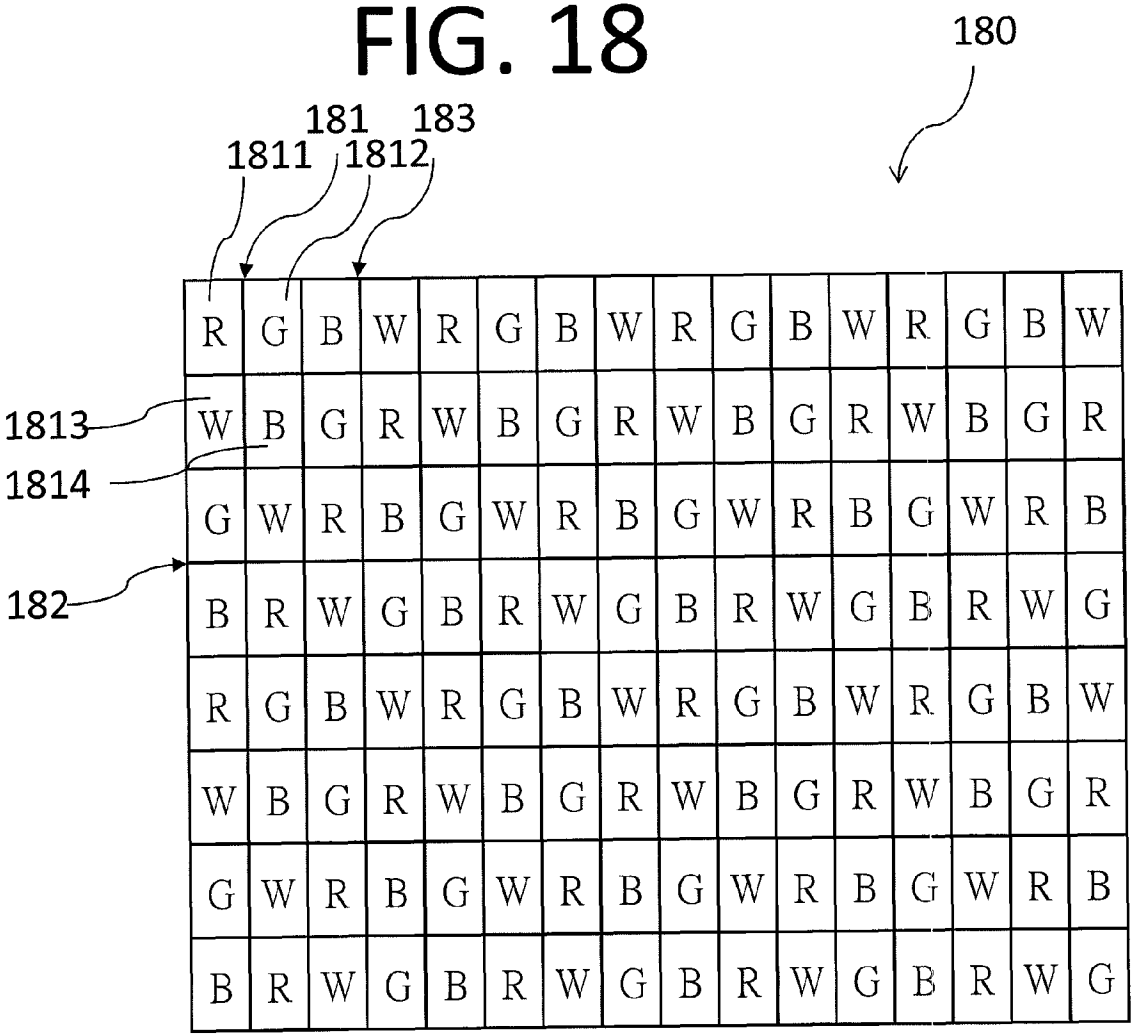
FIG. 18 shows the image device according to a seventeenth embodiment of the invention.

Referring to FIG. 18, it shows the image device according to another embodiment of the invention. The image device 180 includes a plurality of pixel groups 181, 182, 183. Each pixel group includes a plurality of dots arranged in a predetermined identical matrix form, and each pixel group has at least one first color dot, at least one second color dot, at least one third color dot and at least one fourth color dot. For example, the first pixel group 181 has at least one red color dot 1811 (R), at least one green color dot 1812 (G), at least one white color dot 1813 (W) and at least one blue color dot 1814 (B). Any repeated sequence of consecutive color dots in a row direction and in a column direction comprise at least one first color dot, at least one second color dot, at least one third color dot, at least one fourth color dot.

Figure 19:
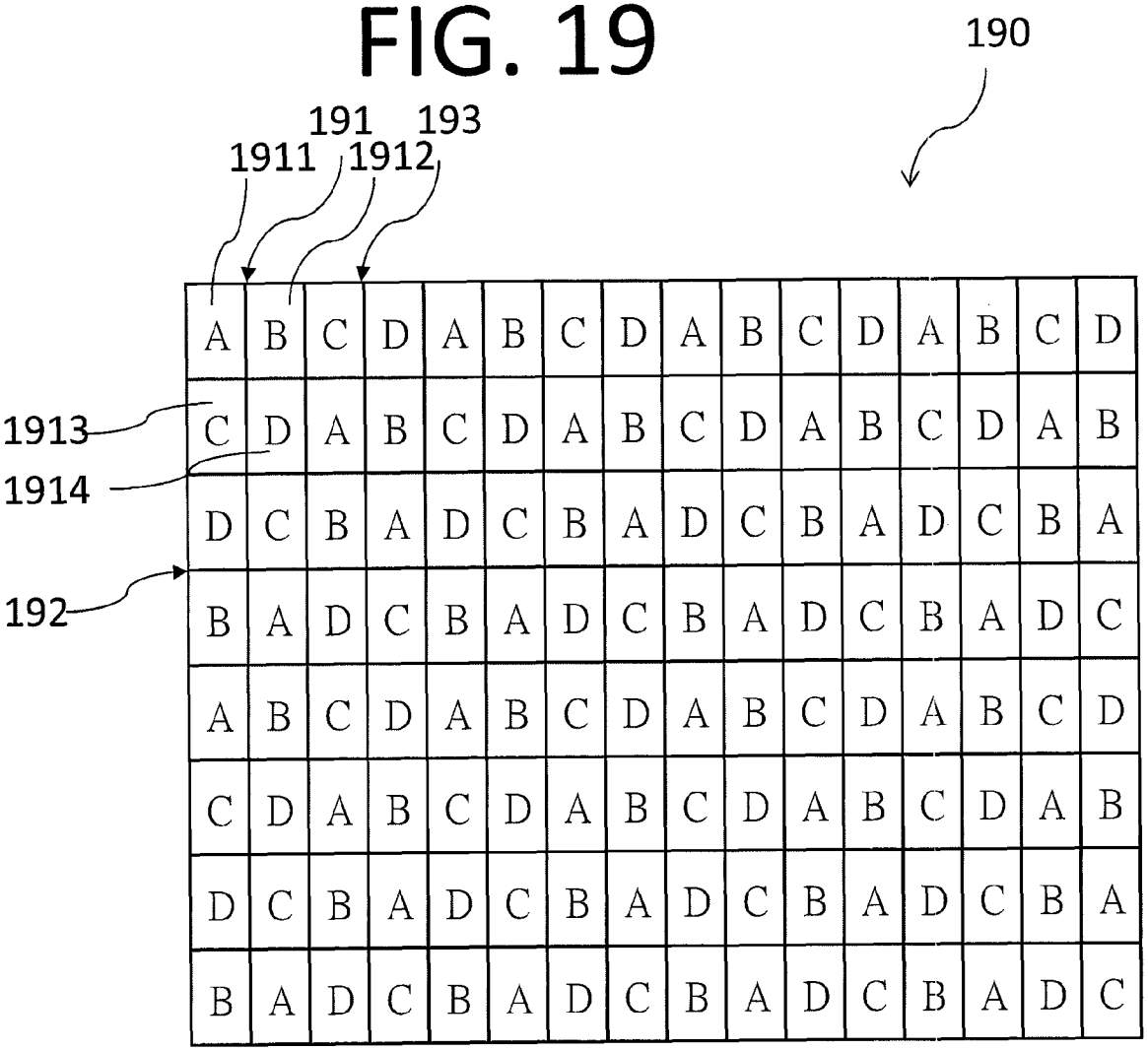
FIG. 19 shows the image device according to an eighteenth embodiment of the invention.

Referring to FIG. 19, it shows the image device according to another embodiment of the invention. The image device 190 includes a plurality of pixel groups 191, 192, 193. Each pixel group includes a plurality of dots arranged in a predetermined identical matrix form, and each pixel group has at least one first color dot, at least one second color dot, at least one third color dot and at least one fourth color dot. For example, the first pixel group 191 has at least one first color dot 1911 (A), at least one second color dot 1912 (B), at least one third color dot 1913 (C) and at least one fourth color dot 1914 (D). Any repeated sequence of consecutive color dots in a row direction and in a column direction comprise at least one first color dot, at least one second color dot, at least one third color dot, at least one fourth color dot.

Figure 20:
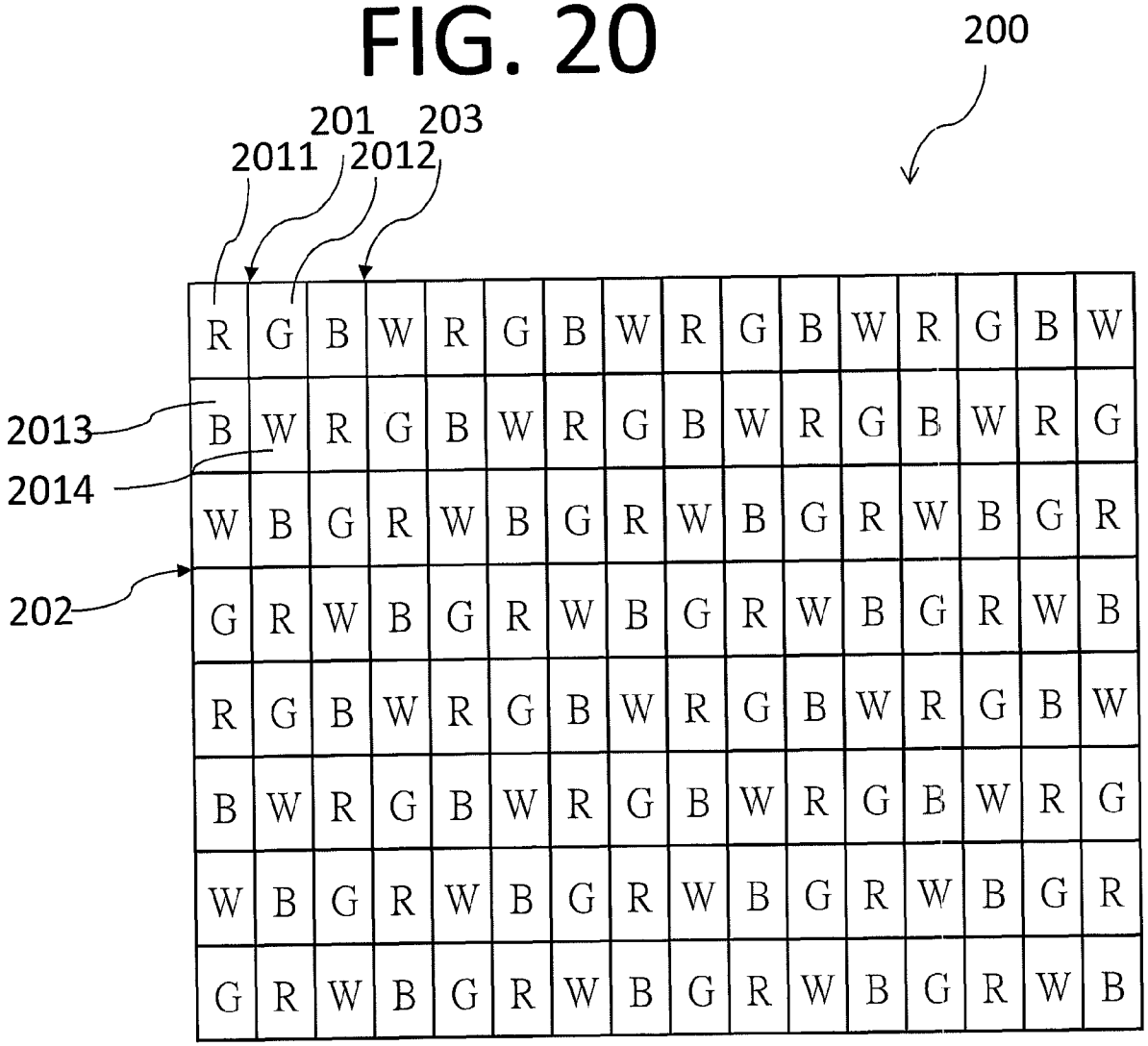
FIG. 20 shows the image device according to a nineteenth embodiment of the invention.

Referring to FIG. 20, it shows the image device according to another embodiment of the invention. The image device 200 includes a plurality of pixel groups 201, 202, 203. Each pixel group includes a plurality of dots arranged in a predetermined identical matrix form, and each pixel group has at least one first color dot, at least one second color dot, at least one third color dot and at least one fourth color dot. For example, the first pixel group 201 has at least one red color dot 2011 (R), at least one green color dot 2012 (G), at least one white color dot 2014 (W) and at least one blue color dot 2013 (B). Any repeated sequence of consecutive color dots in a row direction and in a column direction comprise at least one first color dot, at least one second color dot, at least one third color dot, at least one fourth color dot.

Figure 21:
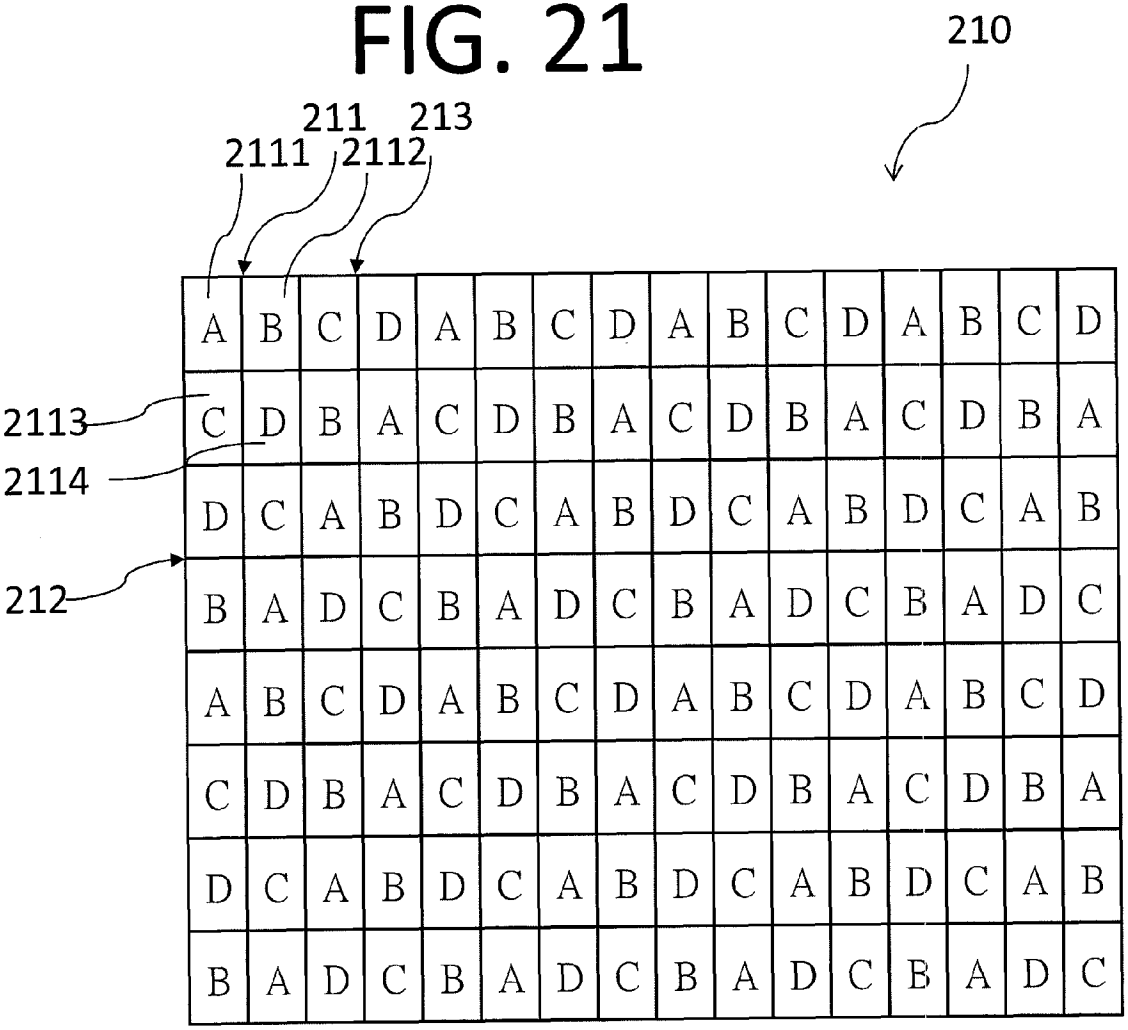
FIG. 21 shows the image device according to a twentieth embodiment of the invention.

Referring to FIG. 21, it shows the image device according to another embodiment of the invention. The image device 210 includes a plurality of pixel groups 211, 212, 213. Each pixel group includes a plurality of dots arranged in a predetermined identical matrix form, and each pixel group has at least one first color dot, at least one second color dot, at least one third color dot and at least one fourth color dot. For example, the first pixel group 211 has at least one first color dot 2111 (A), at least one second color dot 2112 (B), at least one third color dot 2113 (C) and at least one fourth color dot 2114 (D). Any repeated sequence of consecutive color dots in a row direction and in a column direction comprise at least one first color dot, at least one second color dot, at least one third color dot, at least one fourth color dot.

Figure 22:
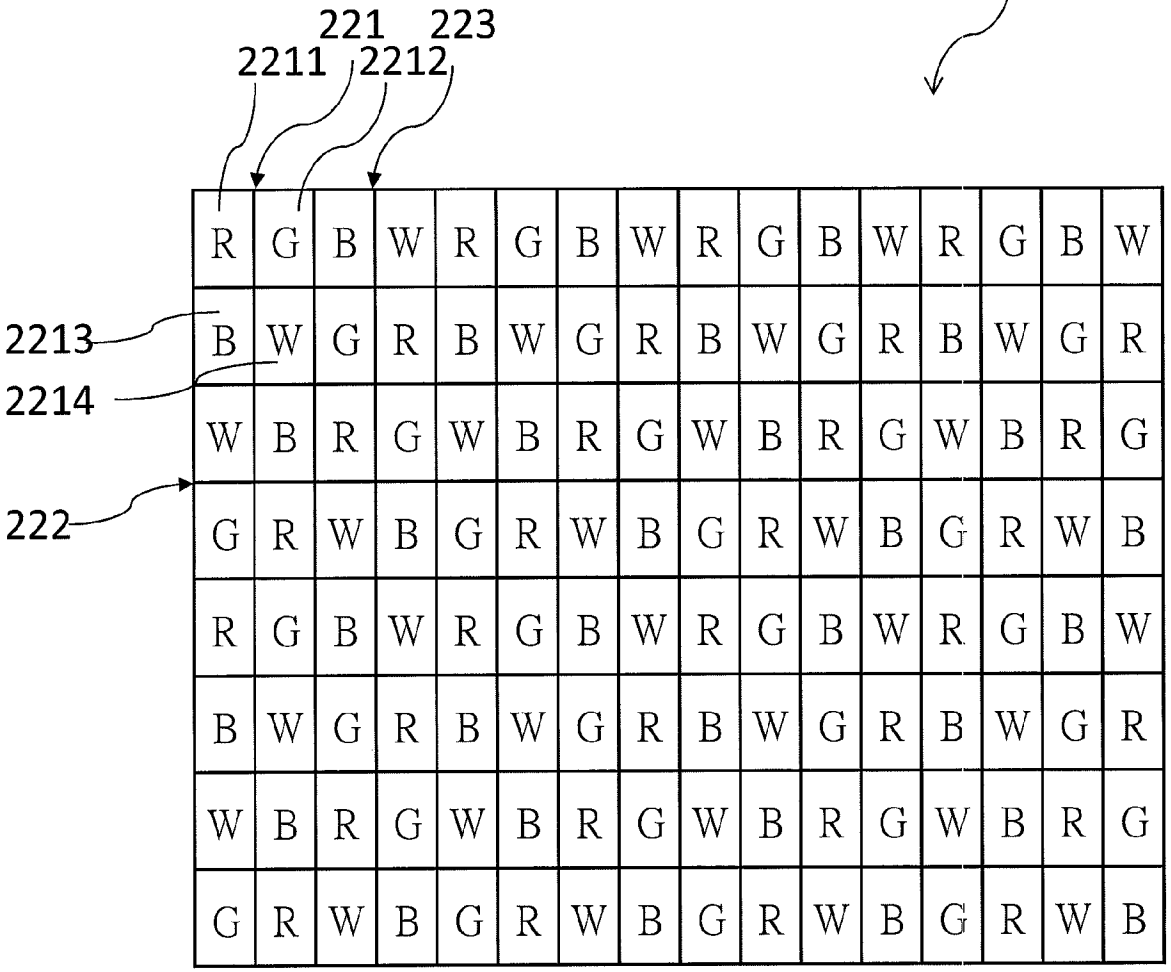
FIG. 22 shows the image device according to a twenty-first embodiment of the invention.

Referring to FIG. 22, it shows the image device according to another embodiment of the invention. The image device 220 includes a plurality of pixel groups 221, 222, 223. Each pixel group includes a plurality of dots arranged in a predetermined identical matrix form, and each pixel group has at least one first color dot, at least one second color dot, at least one third color dot and at least one fourth color dot. For example, the first pixel group 221 has at least one red color dot 2211 (R), at least one green color dot 2212 (G), at least one white color dot 2214 (W) and at least one blue color dot 2213 (B). Any repeated sequence of consecutive color dots in a row direction and in a column direction comprise at least one first color dot, at least one second color dot, at least one third color dot, at least one fourth color dot.

Figure 23:
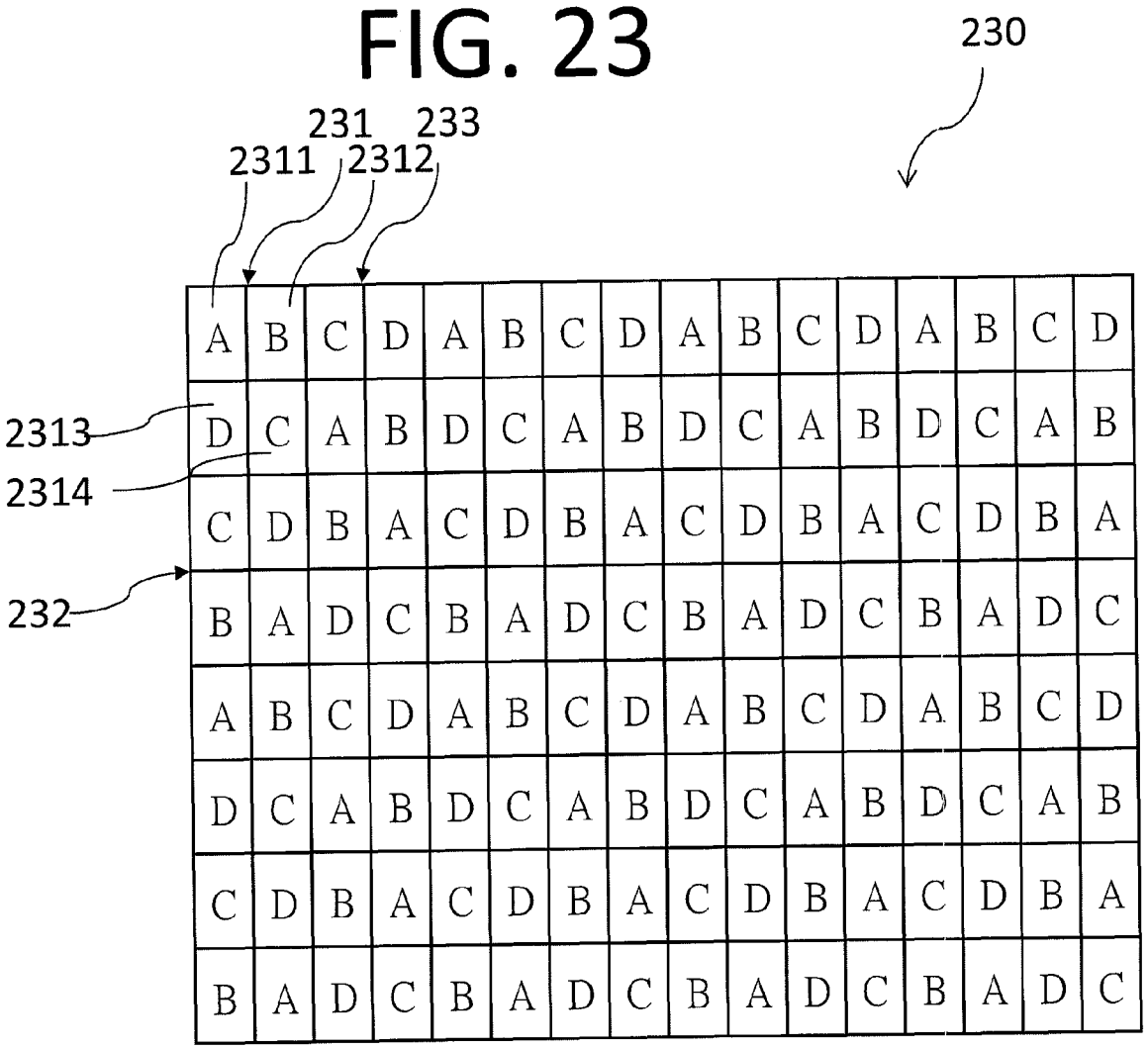
FIG. 23 shows the image device according to a twenty-second embodiment of the invention.

Referring to FIG. 23, it shows the image device according to another embodiment of the invention. The image device 230 includes a plurality of pixel groups 231, 232, 233. Each pixel group includes a plurality of dots arranged in a predetermined identical matrix form, and each pixel group has at least one first color dot, at least one second color dot, at least one third color dot and at least one fourth color dot. For example, the first pixel group 231 has at least one first color dot 2311 (A), at least one second color dot 2312 (B), at least one third color dot 2313 (C) and at least one fourth color dot 2314 (D). Any repeated sequence of consecutive color dots in a row direction and in a column direction comprise at least one first color dot, at least one second color dot, at least one third color dot, at least one fourth color dot.

Figure 24:
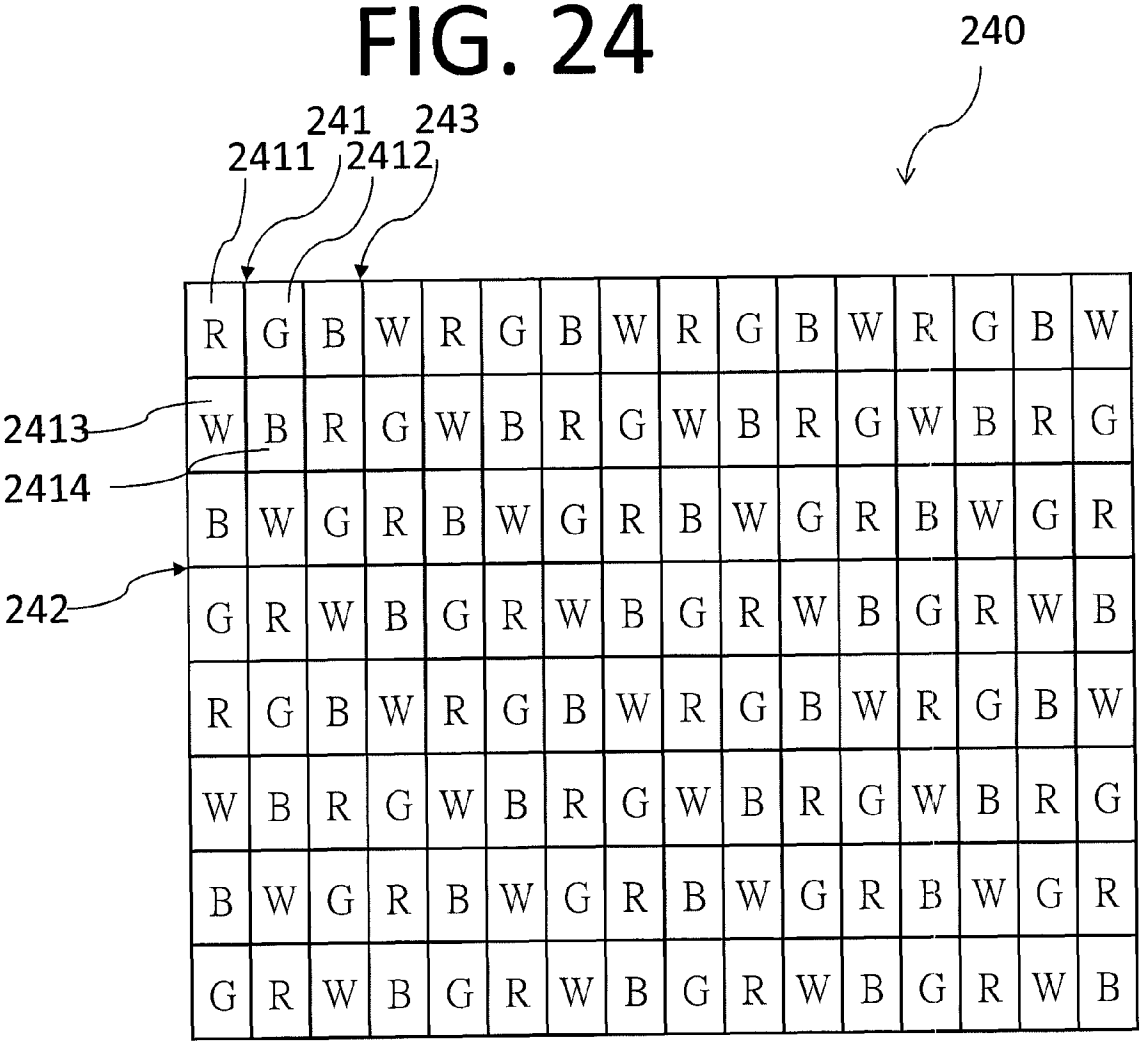
FIG. 24 shows the image device according to a twenty-third embodiment of the invention.

Referring to FIG. 24, it shows the image device according to another embodiment of the invention. The image device 240 includes a plurality of pixel groups 241, 242, 243. Each pixel group includes a plurality of dots arranged in a predetermined identical matrix form, and each pixel group has at least one first color dot, at least one second color dot, at least one third color dot and at least one fourth color dot. For example, the first pixel group 241 has at least one red color dot 2411 (R), at least one green color dot 2412 (G), at least one white color dot 2413 (W) and at least one blue color dot 2414 (B). Any repeated sequence of consecutive color dots in a row direction and in a column direction comprise at least one first color dot, at least one second color dot, at least one third color dot, at least one fourth color dot.

Figure 25:
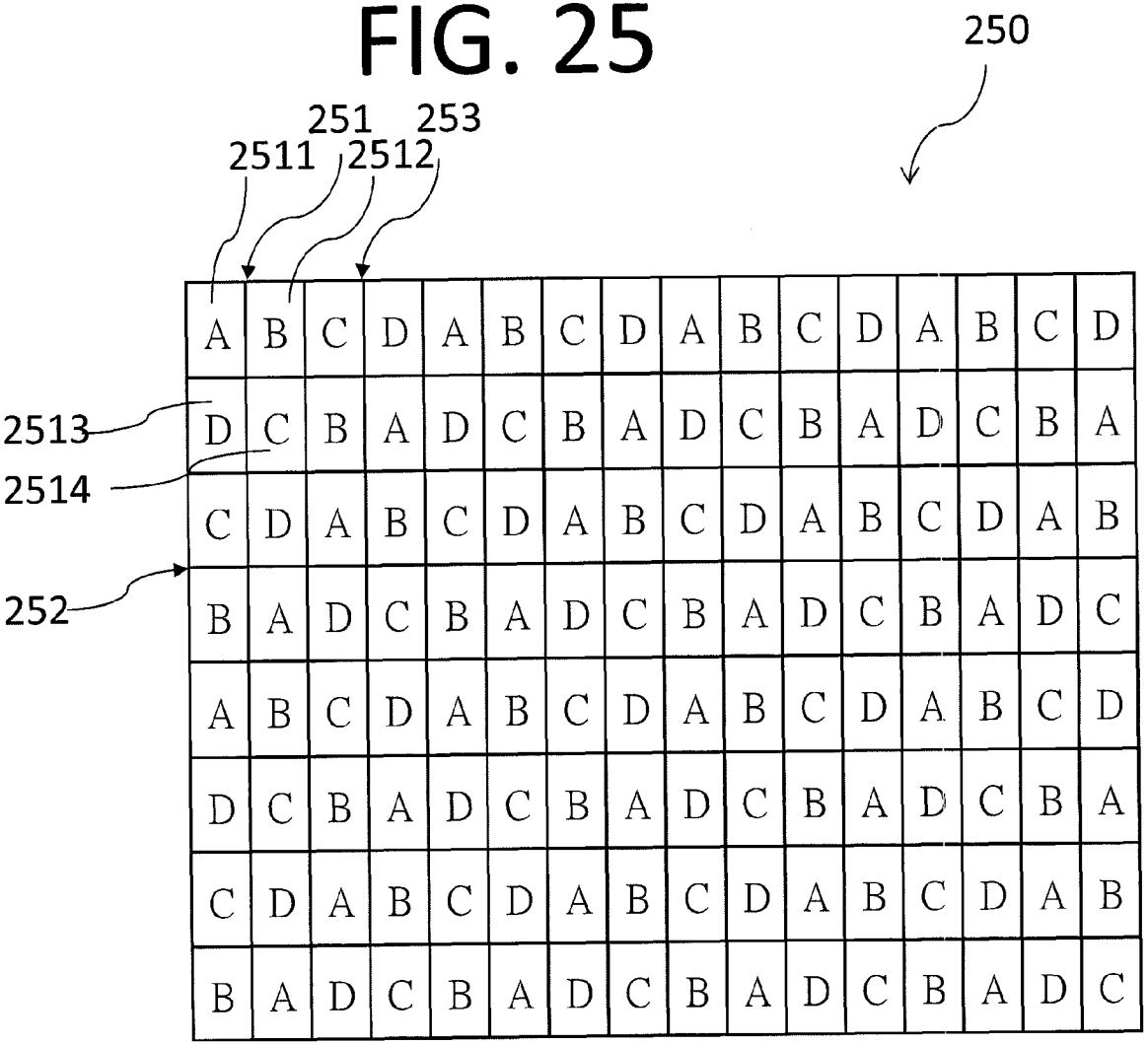
FIG. 25 shows the image device according to a twenty-fourth embodiment of the invention.

Referring to FIG. 25, it shows the image device according to another embodiment of the invention. The image device 250 includes a plurality of pixel groups 251, 252, 253. Each pixel group includes a plurality of dots arranged in a predetermined identical matrix form, and each pixel group has at least one first color dot, at least one second color dot, at least one third color dot and at least one fourth color dot. For example, the first pixel group 251 has at least one first color dot 2511 (A), at least one second color dot 2512 (B), at least one third color dot 2514 (C) and at least one fourth color dot 2513 (D). Any repeated sequence of consecutive color dots in a row direction and in a column direction comprise at least one first color dot, at least one second color dot, at least one third color dot, at least one fourth color dot.

Figure 26:
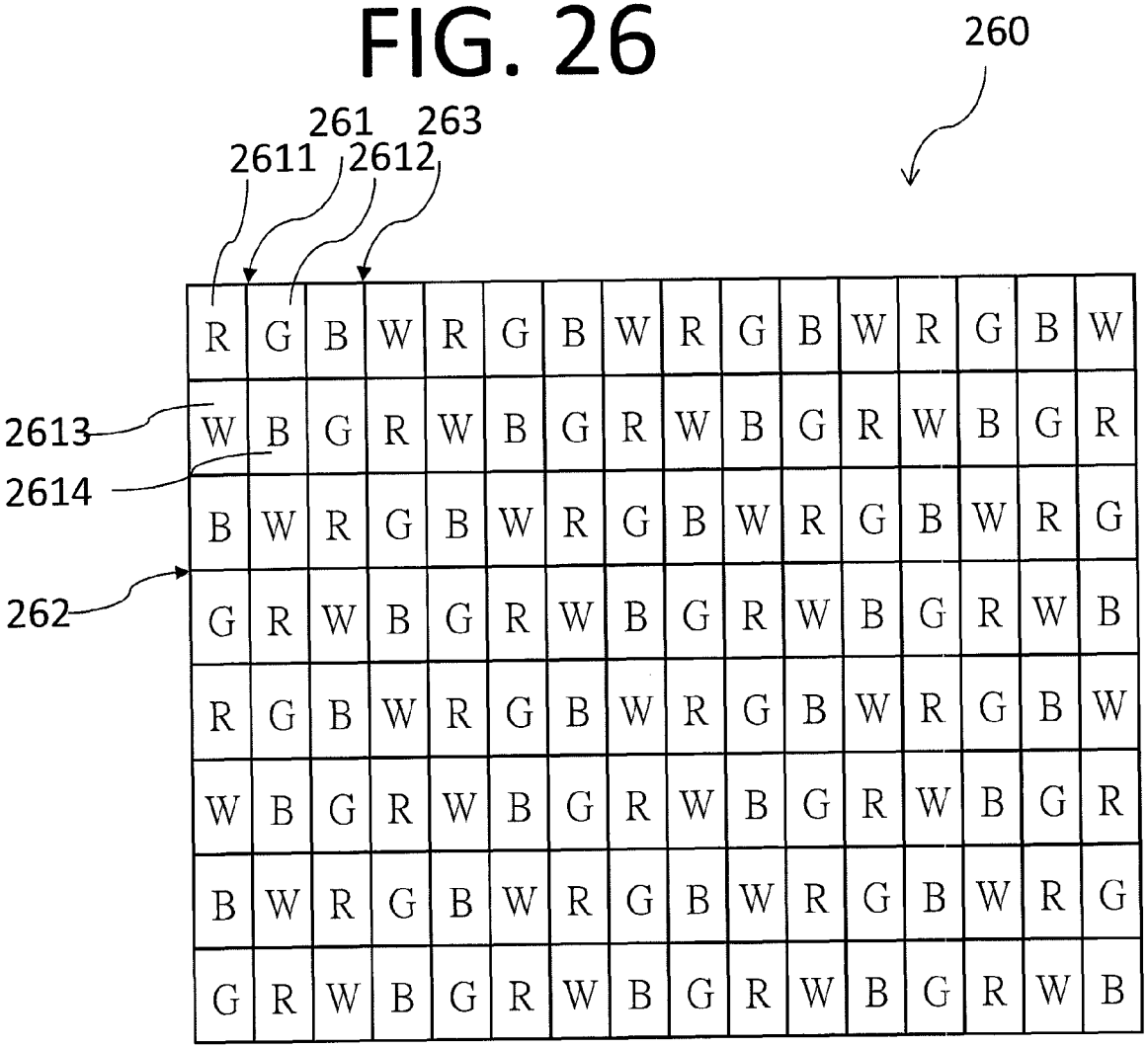
FIG. 26 shows the image device according to a twenty-fifth embodiment of the invention.

Referring to FIG. 26, it shows the image device according to another embodiment of the invention. The image device 260 includes a plurality of pixel groups 261, 262, 263. Each pixel group includes a plurality of dots arranged in a predetermined identical matrix form, and each pixel group has at least one first color dot, at least one second color dot, at least one third color dot and at least one fourth color dot. For example, the first pixel group 261 has at least one red color dot 2611 (R), at least one green color dot 2612 (G), at least one white color dot 2613 (W) and at least one blue color dot 2614 (B). Any repeated sequence of consecutive color dots in a row direction and in a column direction comprise at least one first color dot, at least one second color dot, at least one third color dot, at least one fourth color dot.

Figure 27:
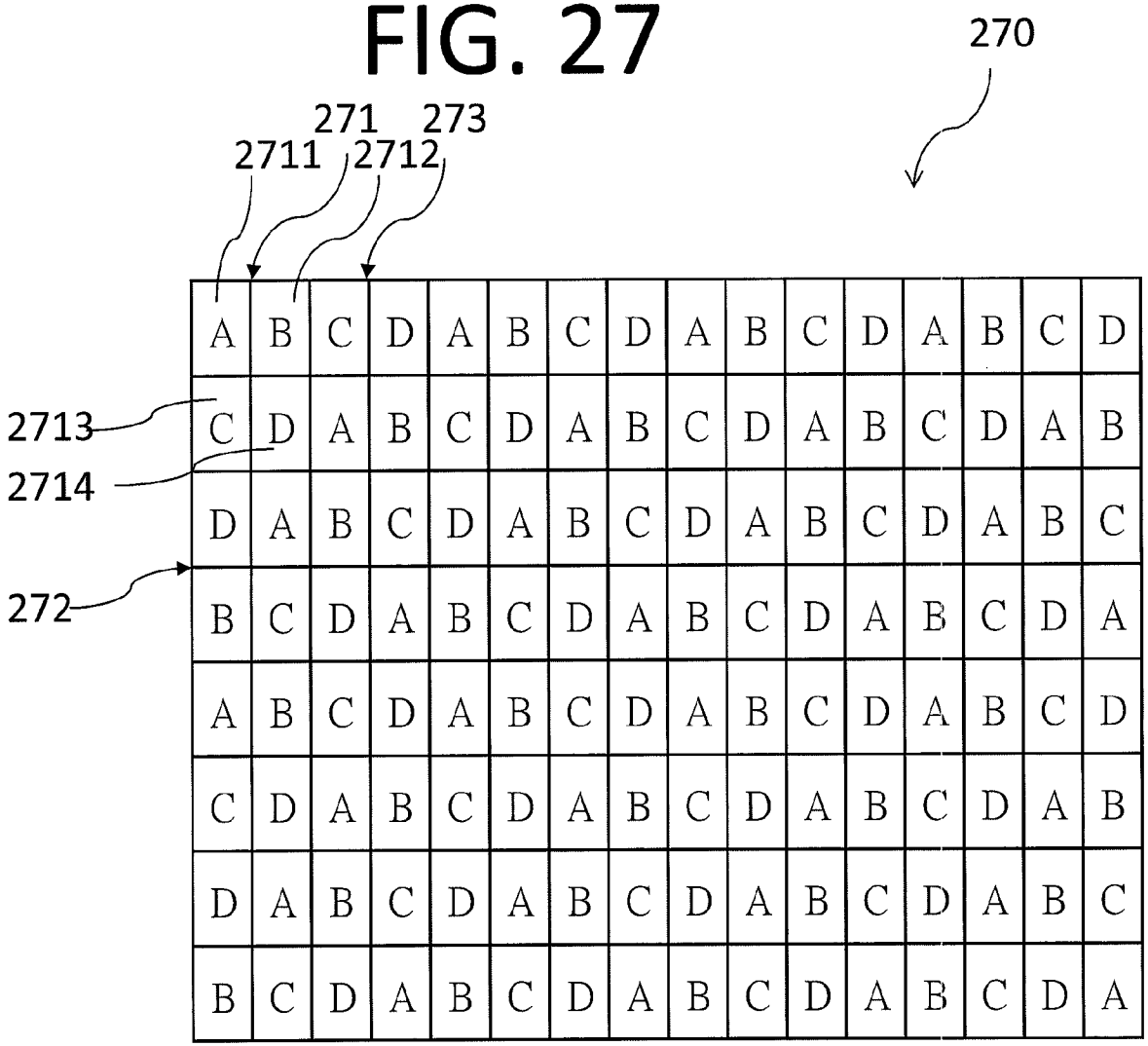
FIG. 27 shows the image device according to a twenty-sixth embodiment of the invention.

Referring to FIG. 27, it shows the image device according to another embodiment of the invention. The image device 270 includes a plurality of pixel groups 271, 272, 273. Each pixel group includes a plurality of dots arranged in a predetermined identical matrix form, and each pixel group has at least one first color dot, at least one second color dot, at least one third color dot and at least one fourth color dot. For example, the first pixel group 271 has at least one first color dot 2711 (A), at least one second color dot 2712 (B), at least one third color dot 2713 (C) and at least one fourth color dot 2714 (D). Any repeated sequence of consecutive color dots in a row direction and in a column direction comprise at least one first color dot, at least one second color dot, at least one third color dot, at least one fourth color dot.

Figure 28:
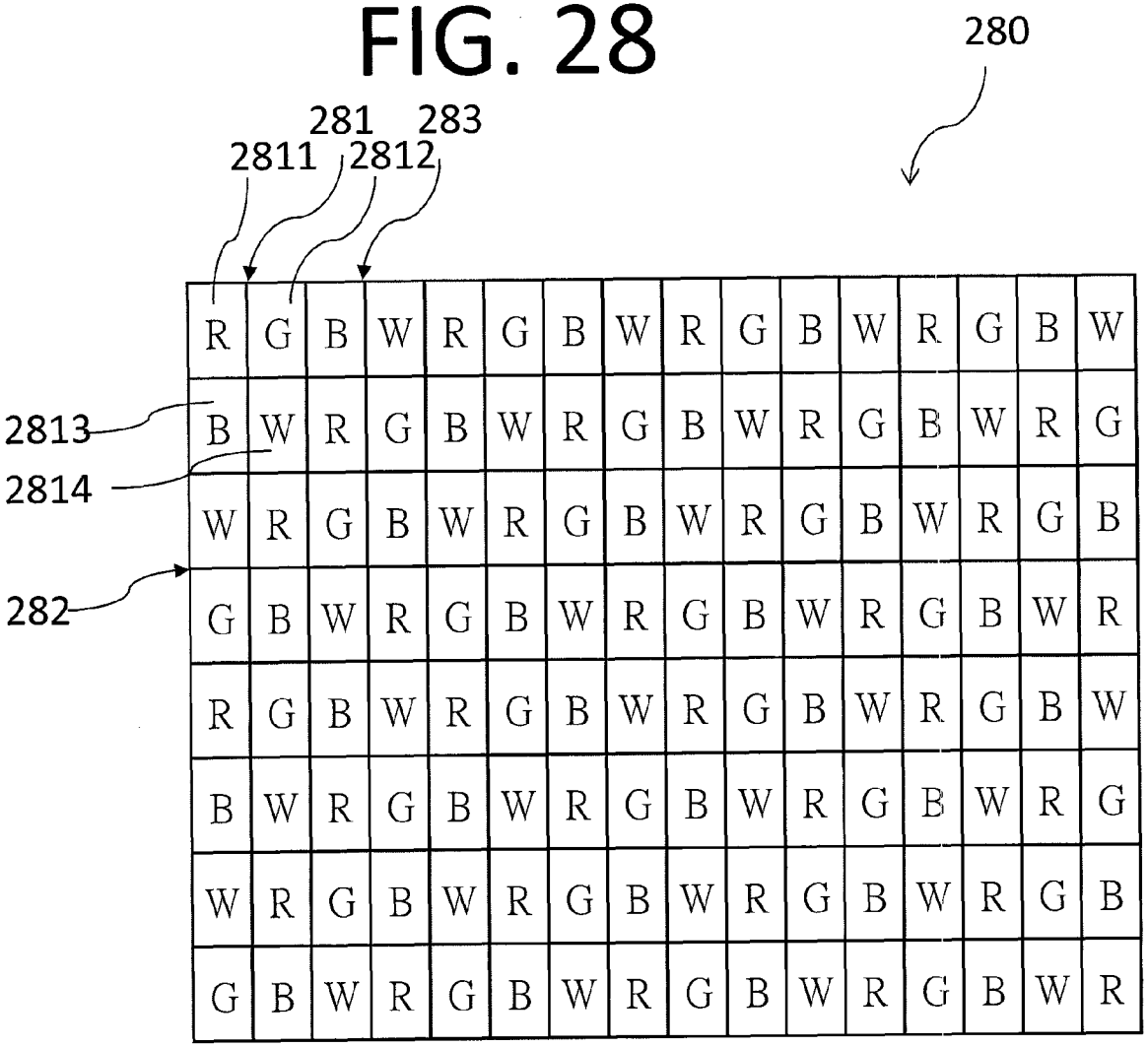
FIG. 28 shows the image device according to a twenty-seventh embodiment of the invention.

Referring to FIG. 28, it shows the image device according to another embodiment of the invention. The image device 280 includes a plurality of pixel groups 281, 282, 263. Each pixel group includes a plurality of dots arranged in a predetermined identical matrix form, and each pixel group has at least one first color dot, at least one second color dot, at least one third color dot and at least one fourth color dot. For example, the first pixel group 281 has at least one red color dot 2811 (R), at least one green color dot 2812 (G), at least one white color dot 2814 (W) and at least one blue color dot 2813 (B). Any repeated sequence of consecutive color dots in a row direction and in a column direction comprise at least one first color dot, at least one second color dot, at least one third color dot, at least one fourth color dot.

Figure 29:
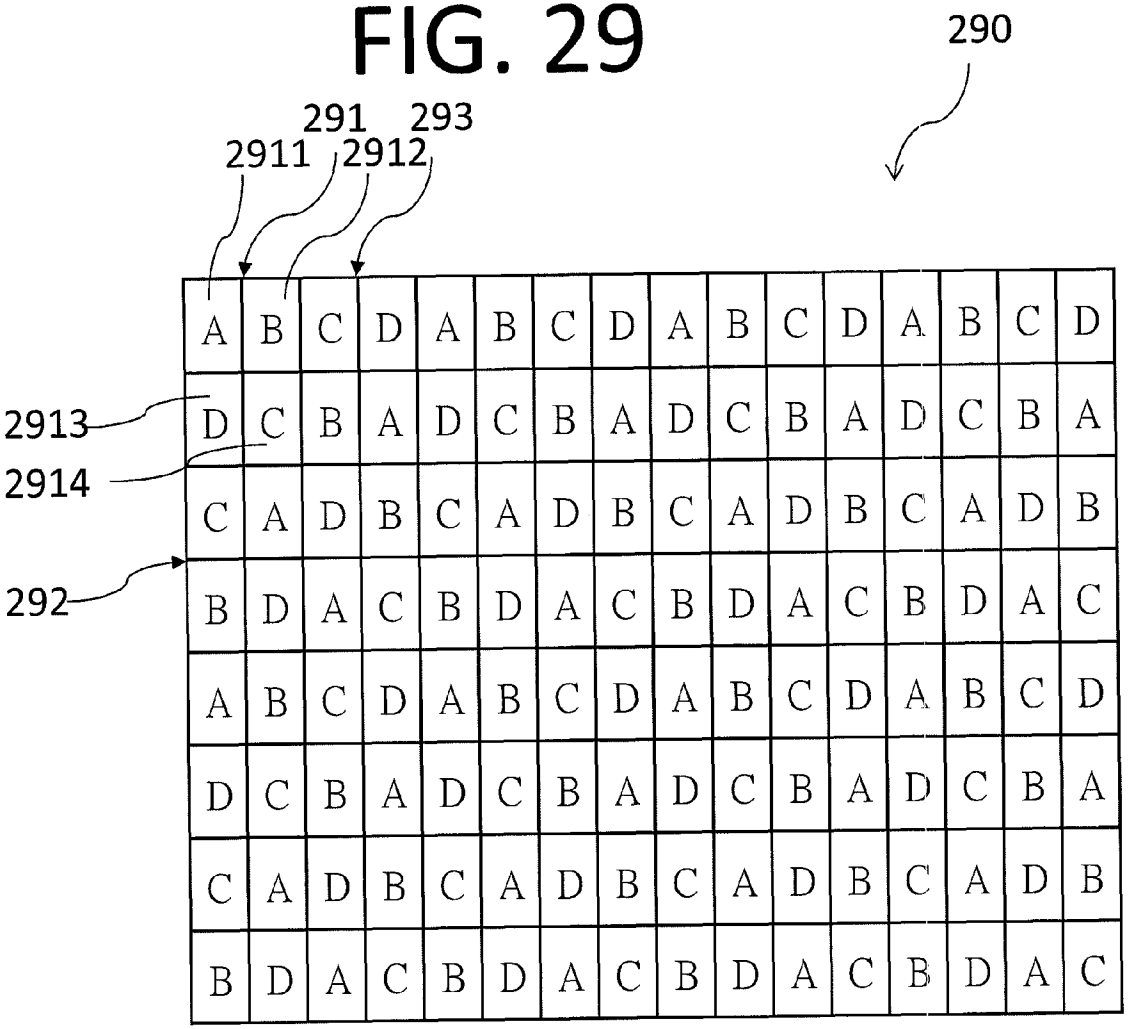
FIG. 29 shows the image device according to a twenty-eighth embodiment of the invention.

Referring to FIG. 29, it shows the image device according to another embodiment of the invention. The image device 290 includes a plurality of pixel groups 291, 292, 293. Each pixel group includes a plurality of dots arranged in a predetermined identical matrix form, and each pixel group has at least one first color dot, at least one second color dot, at least one third color dot and at least one fourth color dot. For example, the first pixel group 291 has at least one first color dot 2911 (A), at least one second color dot 2912 (B), at least one third color dot 2914 (C) and at least one fourth color dot 2913 (D). Any repeated sequence of consecutive color dots in a row direction and in a column direction comprise at least one first color dot, at least one second color dot, at least one third color dot, at least one fourth color dot.

Figure 30:
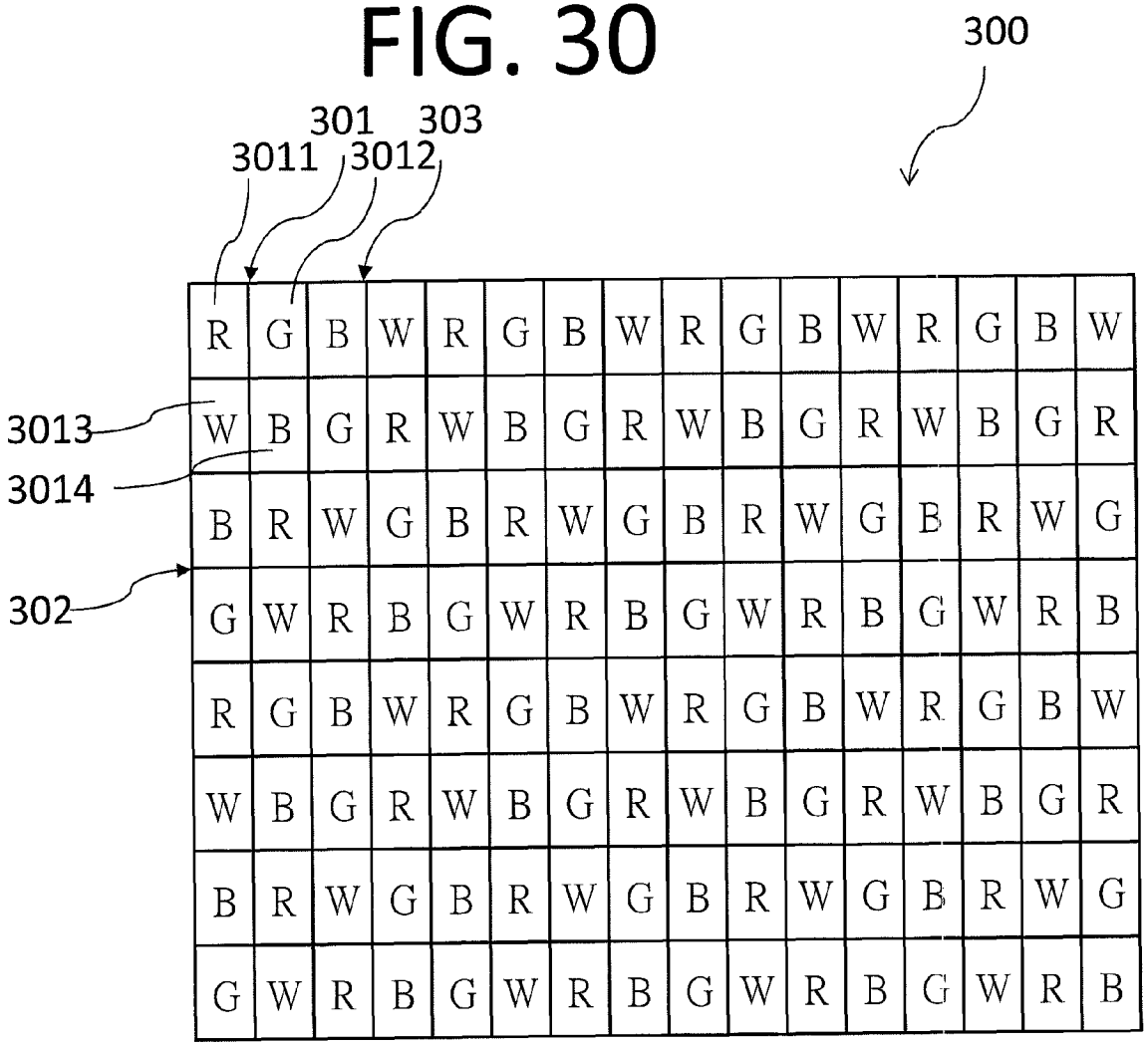
FIG. 30 shows the image device according to a twenty-ninth embodiment of the invention.

Referring to FIG. 30, it shows the image device according to another embodiment of the invention. The image device 300 includes a plurality of pixel groups 301, 302, 303. Each pixel group includes a plurality of dots arranged in a predetermined identical matrix form, and each pixel group has at least one first color dot, at least one second color dot, at least one third color dot and at least one fourth color dot. For example, the first pixel group 301 has at least one red color dot 3011 (R), at least one green color dot 3012 (G), at least one white color dot 3013 (W) and at least one blue color dot 3014 (B). Any repeated sequence of consecutive color dots in a row direction and in a column direction comprise at least one first color dot, at least one second color dot, at least one third color dot, at least one fourth color dot.

While embodiments of the present invention has been illustrated and described, various modifications and improvements can be made by those skilled in the art. The embodiments of the present invention are therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. An image device comprising:

a plurality of pixel groups, each of the pixel groups including a plurality of color dots arranged in a predetermined identical matrix form, and having at least one first color dot, at least one second color dot, at least one third color dot and at least one fourth color dot, any repeated sequence of consecutive color dots in a row direction and in a column direction comprises the at least one first color dot, the at least one second color dot, the at least one third color dot, and the at least one fourth color dot, and multiple diagonal lines of the image device extending parallel to each other, each of multiple diagonal lines comprising a maximum of three of the first color dots, the second color dots, the third color dots, and the fourth color dots, wherein the multiple diagonal lines include a first diagonal line, and a second diagonal line arranged directly adjacent to and parallel to the first diagonal line, wherein the first diagonal line includes along a length thereof:

a first group of two of the first color dots that are directly adjacent to each other, and a second group of two of the first color dots that are directly adjacent to each other, the first and second groups of the first color dots being separated by two others of the color dots having colors different from the first color dots, and wherein the second diagonal line includes along a length thereof:

a first group of two of the second color dots that are directly adjacent to each other, and a second group of two of the second color dots that are directly adjacent to each other, the first and second groups of the second color dots being separated by two others of the color dots having colors different from the second color dots.

2. The image device according to claim 1, wherein the multiple diagonal lines include a third diagonal line directly adjacent to and parallel the second diagonal line, and a fourth diagonal line adjacent to and parallel to the third diagonal line, wherein the third diagonal line includes along a length thereof, a first group of two of the third color dots directly adjacent to each other, and a second group of two of the third color dots directly adjacent to each other, the first and second groups of the third color dots being separated by two others of the color dots having colors different from the third color dots, and the fourth diagonal line includes along a length thereof, a first group of two of the fourth color dots directly adjacent to each other, and a second group of two of the fourth color dots directly adjacent to each other, the first and second groups of the fourth color dots being separated by two others of the color dots having colors different from the fourth color dots.

3. The image device according to claim 2, three and only three of the first color dots, the second color dots, the third color dots, and the fourth color dots, are arranged along each of the first, the second, the third, and the fourth diagonal lines of the image device.

4. The image device according to claim 2, wherein along each of the first, the second, the third, and the fourth diagonal lines of the image device, each of the first color dots, the second color dots, the third color dots, and the fourth color dots is adjacent to another of the color dots having a different color.

5. The image device according to claim 1, wherein each of the first color dots, the second color dots, the third color dots, and the fourth color dots has a dimension in the row direction that is different from a dimension in the column direction.

6. An image device comprising:

a plurality of pixel groups, each of the pixel groups including a plurality of color dots arranged in a predetermined identical matrix form, and having at least one first color dot, at least one second color dot, at least one third color dot and at least one fourth color dot, any repeated sequence of consecutive color dots in a row direction and in a column direction comprises the at least one first color dot, the at least one second color dot, the at least one third color dot, and the at least one fourth color dot, and when the image device is viewed in a diagonal direction of the pixel groups, the color dots can be seen as being arranged sequentially one after another along each of a first diagonal line, a second diagonal line, a third diagonal line, and a fourth diagonal line, and wherein the second diagonal line includes only one of pluralities of the first color dots, or the second color dots, or the third color dots, or the fourth color dots that is arranged in a repeated sequence of consecutive color dots, and the first and third diagonal lines on opposite sides of the second diagonal line include only two of the color dots from among the first color dots, or the second color dots, or the third color dots, or the fourth color dots that are not included in the second diagonal line.

7. The image device according to claim 6, further comprising:

a fifth diagonal line directly adjacent to and parallel to the fourth diagonal line, and a sixth diagonal line directly adjacent to and parallel to the fifth diagonal line, wherein the sixth diagonal line has an identical repeated sequence of consecutive dots as in the second diagonal line, and is separated from the second diagonal line by each of the third diagonal line, the fourth diagonal line, and the fifth diagonal line, and the third diagonal line, the fourth diagonal line, and the fifth diagonal line only have the colors of the first color dots, or the second color dots, or the third color dots, or the fourth color dots that are not included in the second diagonal line.

8. The image device according to claim 7, wherein each of the color dots in the repeated sequence of consecutive color dots in the second diagonal line has the color that is not included in any of the color dots in the first diagonal line and the third diagonal line.

9. The image device according to claim 6, wherein each of the color dots in the repeated sequence of consecutive color dots in the second diagonal line has the color that is not included in any of the color dots in the fourth diagonal line.

10. The image device according to claim 6, wherein each of the first color dots, the second color dots, the third color dots, and the fourth color dots has a dimension in the row direction that is different from a dimension in the column direction.

11. An image device comprising:

a plurality of pixel groups, each of the pixel groups including a plurality of color dots arranged in a predetermined identical matrix form, and having at least one first color dot, at least one second color dot, at least one third color dot and at least one fourth color dot, any repeated sequence of consecutive color dots in a row direction and in a column direction comprises the at least one first color dot, the at least one second color dot, the at least one third color dot, and the at least one fourth color dot, and when the image device is viewed in a first diagonal direction of the pixel groups, the color dots can be seen as being arranged sequentially one after another along each of a first diagonal line, a second diagonal line, a third diagonal line, and a fourth diagonal line, and when the image device is viewed in a second diagonal direction of the pixel groups, the color dots can be seen as being arranged sequentially one after another along each of a first diagonal line, a second diagonal line, a third diagonal line, and a fourth diagonal line, and in the first diagonal direction, each group of the four diagonal lines arranged sequentially one after another includes one of the diagonal lines in the first diagonal direction that contains a repeated sequence of consecutive color dots of the first color, and in the second diagonal direction, each group of the four diagonal lines arranged sequentially one after another includes one of the diagonal lines in the second diagonal direction that contains a repeated sequence of consecutive color dots that is another color that is different from the first color in the first diagonal direction.

12. The image device according to claim 11, wherein each of the first color dots, the second color dots, the third color dots, and the fourth color dots has a dimension in the row direction that is different from a dimension in the column direction.

13. The image device according to claim 11, when the color dots of the repeated sequence of consecutive color dots in each of the row direction and the column direction have substantially a same light intensity, a gray scale color that is produced on the repeated sequence of consecutive color dots.

14. An image device comprising:

a plurality of pixel groups each of which includes a plurality of color dots arranged in a predetermined identical 2×2 matrix form, and having one first color dot A, one second color dot B, one third color dot C, and one fourth color dot D, any repeated sequence of consecutive color dots in a row direction and in a column direction comprises the one first color dot A, the one second color dot B, the one third color dot C, and the one fourth color dot D, the image device having multiple rows each starting at a left hand side of the image device, wherein a first row in the row direction of the image display includes a repeated sequence of the first color dot A, the second color dot B, the third color dot C, and the fourth color dot D, a second row in the row direction of the image display, immediately under the first row, includes a repeated sequence of the fourth color dot D, the third color dot C, the second color dot B and the first color dot A, a third row in the row direction of the image display, immediately under the second row, includes a repeated sequence of the second color dot B, the first color dot A, the fourth color dot D and the third color dot C, and a fourth row in the row direction of the image display, immediately under the third row, includes a repeated sequence of the third color dot C, the fourth color dot D, the first color dot A and the second color dot D, so that each 4×4 matrix of four of the pixel groups includes sixteen of the colors dots arranged as follows:

ABCD
DCBA
BADC
CDAB.

15. An image device comprising:

a plurality of pixel groups each of which includes a plurality of color dots arranged in a predetermined identical 2×2 matrix form, and having one first color dot A, one second color dot B, one third color dot C, and one fourth color dot D, any repeated sequence of consecutive color dots in a row direction and in a column direction comprises the one first color dot A, the one second color dot B, the one third color dot C, and the one fourth color dot D, the image device having multiple rows each starting at a left hand side of the image device, wherein a first row in the row direction of the image display includes a repeated sequence of the first color dot A, the second color dot B, the third color dot C, and the fourth color dot D, a second row in the row direction of the image display, immediately under the first row, includes a repeated sequence of the third color dot C, the fourth color dot D, the first color dot A and the second color dot B, a third row in the row direction of the image display, immediately under the second row, includes a repeated sequence of the fourth color dot D, the third color dot C, the second color dot B and the first color dot A, and a fourth row in the row direction of the image display, immediately under the third row, includes a repeated sequence of the second color dot B, the first color dot A, the fourth color dot D and the third color dot C, so that each 4×4 matrix of four of the pixel groups includes sixteen of the colors dots arranged as follows:

ABCD
CDAB
DCBA
BADC.

* * * * *